US011363891B1

(12) United States Patent
Johnson

(10) Patent No.: US 11,363,891 B1
(45) Date of Patent: Jun. 21, 2022

(54) ELEVATOR SPA, LEG SUPPORT, AND SYSTEM USING SAME

(71) Applicant: Denise Johnson, Clinton, MD (US)

(72) Inventor: Denise Johnson, Clinton, MD (US)

( * ) Notice: Subject to any disclaimer, the term of this patent is extended or adjusted under 35 U.S.C. 154(b) by 0 days.

(21) Appl. No.: 17/185,357

(22) Filed: Feb. 25, 2021

Related U.S. Application Data

(60) Provisional application No. 63/128,888, filed on Dec. 22, 2020.

(51) Int. Cl.
*A47C 16/02* (2006.01)
*A47C 31/00* (2006.01)
*A47K 3/022* (2006.01)

(52) U.S. Cl.
CPC ..... *A47C 16/025* (2013.01); *A47C 31/008* (2013.01); *A47K 3/022* (2013.01)

(58) Field of Classification Search
USPC ..... 297/423.4, 423.39
See application file for complete search history.

(56) References Cited

U.S. PATENT DOCUMENTS

| | | | | |
|---|---|---|---|---|
| 2,709,435 | A | 5/1955 | Kress | |
| 3,696,826 | A | 10/1972 | Gruzalski | |
| 6,230,345 | B1 * | 5/2001 | Borrero | A47C 1/04 5/503.1 |
| D623,448 | S | 9/2010 | Galati, Jr. | |
| 8,341,776 | B2 | 1/2013 | Galati, Jr. | |
| 8,408,652 | B1 * | 4/2013 | Mobley, Sr. | A47C 16/025 297/423.39 |
| 8,956,269 | B1 * | 2/2015 | Skeete | A63B 21/4033 482/139 |
| D783,847 | S | 4/2017 | Galati, Jr. | |
| 9,883,750 | B2 * | 2/2018 | Yi | A47D 9/00 |
| 2005/0204466 | A1 | 9/2005 | Luong | |

* cited by examiner

*Primary Examiner* — Sarah B McPartlin
(74) *Attorney, Agent, or Firm* — Garcia-Zamor Intellectual Property Law, LLC; Ruy Garcia-Zamor

(57) ABSTRACT

A chair add-on, leg support, leg support system, method for retrofitting a chair is described herein. The leg support system is preferably, but not necessarily, easy to use, store, reposition, and/or operate by users of all ages. The leg support system preferably may be constructed directly with a chair. Alternatively, the leg support system may, but does not necessarily, include a remote selectable control.

20 Claims, 19 Drawing Sheets

ELEVATOR SPA, LEG SUPPORT, AND SYSTEM USING SAME

CROSS REFERENCE TO RELATED APPLICATIONS

This application claims priority to and benefit of U.S. provisional patent application 63/128,888, filed Dec. 22, 2020, which is hereby incorporated by reference in its entirety as if fully set forth herein.

BACKGROUND

The present invention is generally directed to chair accessories and, more specifically, to devices for supporting the legs of a user. More specifically still, the invention is directed toward a leg support system which is preferably moveable for optional use with a chair.

Typical leg supporting devices are bulky fixed-positional devices that may or may not include an attached foot bath in the context of a salon or spa. Other devices include a center support so that only one of the two uses legs may be raised at a time. Other devices still do not allow for multi-positioning of the user's legs nor do they allow for easy engagement and disengagement with an existing chair. Typical leg supporting devices cannot be collapsed or easily removed and transported.

Therefore, it may be advantageous to provide any one of: a chair add-on, a chair, a chair modification, a leg support device, and/or a leg support system; each of which may preferably: be multi-positionable, use a mechanical and/or electrical elevator device; have increased comfort; may be more efficient to manufacture; which may be collapsible for easy storage or transit; which may be collapsible for fitting into a carry bag; may be lightweight; may be easily disassembled and assembled via quick connections for ease in placement in carry containers or backpacks; for may be manufactured as part of a chair; may be manufactured as part of a folding chair; may be manufactured as part of a chair retrofit kit, and/or may be used in other arrangements or devices.

SUMMARY

Briefly speaking, one embodiment of the present invention is directed to a leg support system which may be positionable on a supporting surface and may be configured to support a first leg of a user. The leg support system may comprise a first leg support having a first leg support axial end. The leg support system may further comprise a housing. The housing may comprise a first support tower, a second support tower, and a tower connector. The first support tower and the second support tower may be positioned on the supporting surface. The tower connector may have first and second support tower connector axial ends each located on a separate one of the first and second support towers. The tower connector may connect the first support tower to the second support tower. The leg support system may further comprise a first elevator mechanism located in the first support tower. The first elevator mechanism may be configured to raise and/or lower a first height of the tower connector. The first height may be measured from the supporting surface. The leg support system may further comprise a first drive component linking the first leg support to the first elevator mechanism such that first elevator mechanism may be configured to raise and/or lower a second height of the first leg support. The second height may be measured from the supporting surface. The leg support system may also comprise a selectable control for operating the first elevator mechanism. The selectable control may be in communication with the first elevator mechanism and may be configured to activate the first elevator mechanism. The leg support system may be configured to allow the user to adjust the position of the first leg support.

In a separate embodiment, the present invention is directed to a leg support system. The leg support system may comprise a first leg support. The first leg support may comprise a first leg support distal end opposite the first leg support axial end. The first leg support may further comprise a first leg pad configured to contact and support the user's leg. The first leg support distal end may attach to the first leg pad.

In a separate embodiment, the present invention is directed to a leg support system. The leg support system may comprise a housing. The housing may comprise a first support tower, a second support tower, and a tower connector. The tower connector may be configured to be telescopic such that a distance between the first support tower and the second support tower can be adjusted.

In a separate embodiment, the present invention is directed to a leg support system. The leg support system may comprise a housing. The housing may comprise a first support tower, a second support tower, and a tower connector. The first support tower and the second support tower may each comprise a distal end configured for placement closest to the supporting surface. Each of the distal ends may have a plurality of wheels thereon which may configured to contact the supporting surface.

In a separate embodiment, the present invention is directed to a leg support system. The leg support system may comprise a housing. The housing may comprise a first support tower, a second support tower, and a tower connector. The first support tower may define at least one tower connector slot and at least one drive component slot. The at least one tower connector slot may be configured to accommodate the tower connector. The at least one drive component slot may be configured to accommodate the first drive component.

In a separate embodiment, the present invention is directed to a leg support system. The leg support system may comprise a housing. The housing may comprise a first support tower, a second support tower, and a tower connector. The first support tower may define at least one tower connector slot and at least one drive component slot. The at least one tower connector slot may be configured to accommodate the tower connector. The tower connector may extend through the at least one tower connector slot to engage the first elevator mechanism which may be configured to adjust the first height of the tower connector.

In a separate embodiment, the present invention is directed to a leg support system. The leg support system may comprise a housing. The housing may comprise a first support tower, a second support tower, and a tower connector. The first support tower may define at least one tower connector slot and at least one drive component slot. The at least one drive component slot may comprise a first drive component slot and a second drive component slot. The first drive component may comprise first and second rods. The first elevator mechanism may be configured to adjust the position of the first and second rods in the first and second drive component slots such that the second height of the first leg support can be varied and such that an angle of the first leg support relative to the supporting surface can be adjusted.

In a separate embodiment, the present invention is directed to a leg support system. The leg support system may comprise a housing. The housing may comprise a first support tower, a second support tower, and a tower connector. The first support tower may define at least one tower connector slot and at least one drive component slot. The leg support system may further comprise a first drive component. The first drive component may comprise a drive housing enclosing a motor. The drive housing may be engaged with the elevator mechanism through the at least one drive component slot such that the first elevator mechanism can adjust the second height of the first leg support. The motor may be configured to adjust an angle of the first leg support relative to the supporting surface.

In a separate embodiment, the present invention is directed to a leg support system. The leg support system may comprise a first elevator mechanism. The first elevator mechanism may comprise at least one elevator motor. The first elevator mechanism may further comprise a plurality of threaded rods positioned generally perpendicular to the supporting surface and configured to be rotated by the at least one elevator motor. The first elevator mechanism may also comprise a plurality of riding elements each having one of the plurality of threaded rods extending therethrough such that rotation of the one of the plurality of rods may adjust a vertical position of the riding element. The first elevator mechanism additionally may comprise an edge of the at least one tower connector slot and/or the at least one drive component slot that may be configured to prevent rotation of the plurality of riding elements such that rotation of the plurality of rods may be translated into vertical motion of the plurality of riding elements.

In a separate embodiment, the present invention is directed to a leg support system. The leg support system may comprise a first elevator mechanism. The first elevator mechanism may comprise at least one elevator motor. The first elevator mechanism may further comprise a plurality of threaded rods which may be, but are not necessarily, positioned generally perpendicular to the supporting surface and configured to be rotated by the at least one elevator motor. The first elevator mechanism may also comprise a plurality of riding elements each having one of the plurality of threaded rods extending therethrough such that rotation of the one of the plurality of rods may adjust a vertical position of the riding element. Each of the plurality of riding elements may be prevented from rotating by one of the tower connector and the first drive component such that rotation of the plurality of rods may be translated into vertical motion of the plurality of riding elements.

In a separate embodiment, the present invention is directed to leg support system. The leg support system may comprise a first elevator mechanism. The first elevator mechanism may comprise at least one elevator motor. The first elevator mechanism may also comprise a plurality of threaded rods positioned generally perpendicular to the supporting surface and configured to be rotated by the at least one elevator motor. Each of the tower connector and the first drive component may be engaged with at least one of the plurality of threaded rods such that rotation of the at least one of the plurality of rods may adjust a vertical position thereof.

In a separate embodiment, the present invention is directed to a leg support system. The leg support system may comprise a housing. The housing may comprise a first support tower, a second support tower, and a tower connector. The housing may be configured such that the tower connector may be adapted to be positioned underneath an underside of a chair. The tower connector may then raised by the first elevator mechanism to contact the underside so that the housing can be braced between the chair and the supporting surface.

In a separate embodiment, the present invention is directed to a leg support system. The leg support system may comprise a chair. The leg support system may also comprise a housing. The housing may comprise a first support tower, a second support tower, and a tower connector. The housing may be configured such that the tower connector may be adapted to be positioned underneath an underside of a chair. The tower connector may then raised by the first elevator mechanism to contact the underside so that the housing can be braced between the chair and the supporting surface.

In a separate embodiment, the present invention is directed to a leg support system. The leg support system may comprise a chair.

In a separate embodiment, the present invention is directed to a leg support system. The leg support system may comprise a chair. The leg support system may further comprise a bracket positioned on the underside of the chair. The bracket may define a channel therein. The tower connector may have an upper portion defined by a flange such that when the tower connector may be raised to brace against the chair the flange may be inserted into the channel of the bracket.

In a separate embodiment, the present invention is directed to a leg support system. The leg support system may comprise a chair. The leg support system may further comprise a tower connector. A wing plate may be located on the tower connector which may be moveable between a first, folded, position in which the wing plate may be generally parallel to the tower connector and a second, extended position in which the wing plate may extend outwardly away from the tower connector to contact a portion of the underside of the chair.

In a separate embodiment, the present invention is directed to a leg support system. The leg support system may comprise a tower connector. The tower connector may comprise two crossbars with a plate therebetween.

In a separate embodiment, the present invention is directed to a leg support system. The leg support system may comprise a housing. The housing may comprise a first support tower, a second support tower, and a tower connector. The leg support system may further comprise a first strut positioned on the first support tower and extending away from the first support tower. The first strut may be configured to contact the supporting surface so that the housing has extra resistance to pivoting about a bottom of the first and second support towers.

In a separate embodiment, the present invention is directed to a combination chair and leg support system which may be positionable on a supporting surface and may be configured to support a first leg of a user. The chair may comprise a chairback and a seat having an underside. The leg support system may comprise a first leg support having a first leg support axial end. The leg support system may further comprise a housing. The housing may comprise a first support tower, a second support tower, and a tower connector. The first support tower and the second support tower may be positioned on the supporting surface. The tower connector may have first and second support tower connector axial ends each located on a separate one of the first and second support towers. The tower connector may connect the first support tower to the second support tower. The leg support system may further comprise a first elevator mechanism located in the first support tower. The first elevator mechanism may be configured to raise and/or lower a first height of the tower connector. The first height may be measured from the supporting surface. The leg support system may further comprise a first drive component linking the first leg support to the first elevator mechanism such that first elevator mechanism may be configured to raise and/or lower a second height of the first leg support. The second height may be measured from the supporting surface. The leg support system may also comprise a selectable control for operating the first elevator mechanism. The selectable control may be in communication with the first elevator mechanism and may be configured to activate the first elevator mechanism. The leg support system may be configured to allow the user to adjust the position of the first leg support.

In a separate embodiment, the present invention may be directed to a leg support system comprising a first leg support having a first leg support axial end. The leg support system may further comprise a housing. The housing may comprise a first support tower and a tower brace. The first support tower may be positioned on the supporting surface. The leg support system may further comprise a first elevator mechanism located in the first support tower. The first elevator mechanism may be configured to raise and/or lower a first height of the tower brace. The first height may be measured from the supporting surface. The leg support system may further comprise a first drive component linking the first leg support to the first elevator mechanism such that first elevator mechanism may be configured to raise and/or lower a second height of the first leg support. The second height may be measured from the supporting surface. The leg support system may also comprise a selectable control for operating the first elevator mechanism. The selectable control may be in communication with the first elevator mechanism and may be configured to activate the first elevator mechanism. The leg support system may be configured to allow the user to adjust the position of the first leg support.

In a separate embodiment, the present invention may be directed to a leg support system wherein a single leg support can be positioned along the side of a spa chair, or other chair. It is preferable that the single leg support is configured to tend to stay in position proximate to the chair, possibly by engagement/abutment with some sort of engagement with a surface of the chair such that the leg support may be sandwiched therebetween or have forces acting thereon due to the spa chair and supporting surface which tend to resist movement of the leg support.

In a separate embodiment, the present invention may be directed to a leg support system wherein a pair of single leg supports, which are preferably detached from each other, can preferably be positioned along opposite sides of a spa chair, or other chair. It is preferable that the pair of single leg supports are configured to tend to stay in position proximate to the chair, possibly by engagement/abutment with some sort of surface of the chair and with some sort of engagement or abutment with a supporting surface such that the pair of leg supports may be sandwiched therebetween or have forces acting thereon due to the spa chair and supporting surface which result in a tendency of the pair of leg supports to resist moving.

In a separate embodiment, the present invention may be directed to a leg support system wherein a pair of single leg supports, which are preferably detached from each other, can preferably be positioned along opposite sides of a spa chair, or other chair. It is preferable that the pair of single leg supports are configured to tend to stay in position proximate to the chair so that they cannot be moved laterally away therefrom to prevent a person sitting in the chair from being able to use the leg support. This preferably also prevents the possibility of injury of a person during use.

In a separate embodiment, the present invention is directed to a chair. The chair may comprise a chairback and a seat. The chair may also comprise a leg support system. The leg support system may be operated by a user in order to position the first leg support at a desired height and angle. The leg support system may be detachably affixed to the chair.

In a separate embodiment, the present invention is directed to a leg support system to be used with the chair. The tower connector may be telescopic or otherwise collapsible (or easy to disassemble possibly using quick connects or the like) such that the distance between the first support tower and the second support tower may be increased or decreased.

In a separate embodiment, the present invention is directed to a leg support system. The leg support system may comprise a first leg support. The leg support system may further comprise a housing. The leg support system may also comprise a first elevator mechanism. The leg support system additionally may comprise a selectable control for operating the first elevator mechanism.

In a separate embodiment, the present invention is directed to a leg support system. The leg support system may be used of the chair or other seating device anywhere that leg support of a user is desired.

In a separate embodiment, the present invention is directed to a leg support which is moveably positionable on a supporting surface. This allows the leg support to be stored on site or easily packed away when not in use and to be easily positionable under a chair as needed.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. At least one of the embodiments of the present invention is accurately represented by this application's drawings which are relied on to illustrate such embodiment(s) to scale and the drawings are relied on to illustrate the relative size, proportions, and positioning of the individual components of the present invention accurately relative to each other and relative to the overall embodiment(s). Those of ordinary skill in the art will appreciate from this disclosure that the present invention is not limited to the scaled drawings and that the illustrated proportions, scale, and relative positioning can be varied without departing from the scope of the present invention as set forth in the broadest descriptions set forth in any portion of the originally filed specification and/or drawings. It is understood, however, that the invention is not limited to the precise arrangements and instrumentalities shown. In the drawings.

DETAILED DESCRIPTION OF THE PREFERRED EMBODIMENT

Figure 1:
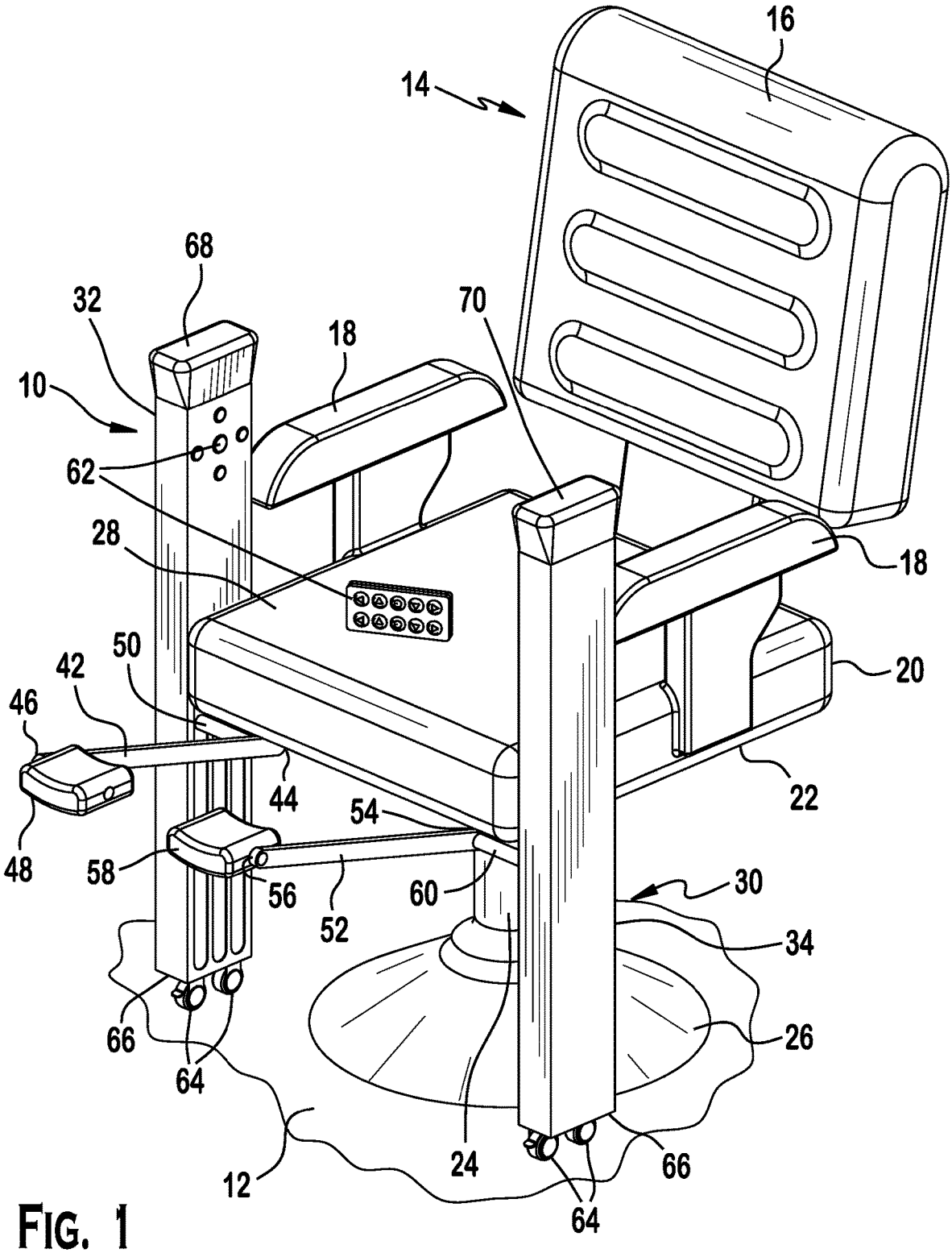
FIG. 1 is a front perspective view of a leg support system 10 in the preferred embodiment shown in use with a chair 14. This figure illustrates the leg support system 10 and the chair 14 both positioned on the supporting surface 12. The chair 14 may comprise a seatback 16, armrests 18, and a seat 20. The seat 20 may comprise an underside 22. The underside 22 may connect to a chair support post 24 which in turn is connected to a chair attachment portion 26. The chair attachment portion 26 is preferably detachably affixed and positioned on the supporting surface 12. The chair 14 may also comprise a topside 28.

Certain terminology is used in the following description for convenience only and is not limiting. The words "right," "left," "up," and "down" designate the directions as they would be understood by a person facing in the viewing direction unless specified otherwise. At least one of the embodiments of the present invention is accurately represented by this application's drawings which are relied on to illustrate such embodiment(s) to scale and the drawings are relied on to illustrate the relative size, proportions, and positioning of the individual components of the present invention accurately relative to each other and relative to the overall embodiment(s). Those of ordinary skill in the art will appreciate from this disclosure that the present invention is not limited to the scaled drawings and that the illustrated proportions, scale, and relative positioning can be varied without departing from the scope of the present invention as set forth in the broadest descriptions set forth in any portion of the originally filed specification and/or drawings. The words "outer" and "inner" refer to directions away from and toward, respectively, the geometric center of the specified element, or, if no part is specified, the geometric center of the hinge system 10. The terms "downward" and "upward refers to directions above and below the chair seat frame 34, respectively, unless specified otherwise. The terms "forward" and "front" refer to a direction in front of the leg support system 10, or the chair 14, and the term "rear" refers to a direction behind the leg support system 10, or the chair 14. The terms "axial" and "radial" refer to directions along and around the first leg support 42, respectively, and the tower connector 36, respectively. The terms "touching," "abutting," "against," and "contacting" when used in connection with two surfaces is defined as meaning "being positioned anywhere between actual touching of two surfaces to being in facing orientation and within 1 inch (or 2.54 centimeters) apart." Those of ordinary skill in the art will appreciate from this disclosure that skill in the art will appreciate from this disclosure that when a range is provided, such as (for example) an angle/distance/number/weight/volume/spacing being between one (1 of the appropriate unit) and ten (10 of the appropriate units), that specific support is thereby provided by the specification to identify any number within the range as being disclosed for use with a preferred embodiment. For example, the recitation of a percentage of copper between one percent (1%) and twenty percent (20%) provides specific support for a preferred embodiment having two point three percent (2.3%) copper even if not separately listed herein and thus provides support for claiming a preferred embodiment having two point three percent (2.3%) copper. The language "at least one of 'A', 'B', and 'C'," as used in the claims and in corresponding portions of the specification, means "any group having at least one 'A'; or any group having at least one 'B'; or any group having at least one 'C'; —and does require that a group have at least one of each of 'A', 'B', and 'C'." More specifically, the language 'at least two/three of the following list' (the list itemizing items '1', '2', '3', '4', etc.), as used in the claims, means at least two/three total items selected from the list and does not mean two/three of each item in the list. The term "interior", as used in the claims and corresponding portions of the specification means the area proximate to the center of the invention. The term "exterior" similarly defines the area not in proximity to the center of the invention. Additionally, the words "a" and "one" are defined as including one or more of the referenced items unless specifically stated otherwise. The term "selectable control" (i.e., selectable control 62), as used in the claims and the corresponding portions of the specification, means "any one of a physical switch, a touch switch, a button, a voice activated switch, a control knob, a remote control switch, or any other known operating mode selection device". The term "activated state", as used with selectable control, means that the selectable control has been manipulated so that the selectable control is set for a particular function. For example, if the selectable control is a simple switch, then the activated state may be having the switch turned to another position and if the selectable control is a touch sensor, then the activated state may be initiated by depressing or touching the sensor in a predetermined manner. The terminology includes the words specifically mentioned above, derivatives thereof, and words of similar import.

Referring generally to FIGS. 1-35, wherein like numerals indicate like elements throughout, a leg support system 10 is disclosed in its preferred embodiment. Preferably, the leg support system 10 may be used with a chair 14 and a spa chair 170 to allow a user of the chair 14 to adjust the height and the angle of the first and second leg supports 42, 52. Multiple alternative preferred embodiments of the leg support system 10 are also disclosed. The chair 14 may comprise the leg support system 10 or at least the elements of the leg support system 10. One of ordinary skill in the pertinent art will appreciate from this disclosure, however, that the leg support system 10 may be used with a variety of other devices and apparatuses for seating or resting objects that require the rotational, height-adjustable, supporting, and other functionality provided by the leg support system 10 without departing from the scope of the present invention.

May components of the leg support system 10, such as a drive mechanism 50, first leg support 42, and tower connector 36 are preferably formed of a strong durable material, such as stainless steel or alloy or the like. However, those of ordinary skill in the art will appreciate from this disclosure that the leg support system 10 can be manufactured with any other suitable materials without departing from the scope of the present invention from the present invention. Similarly, the housing 30 may comprise a polymer or any other suitable material without departing from the scope of the present invention. The elevator mechanisms 100 are preferably powered by AC power. Those of ordinary skill in the art will appreciate from this disclosure that the elevator mechanisms can be powered by batteries or any other suitable power source without departing from the scope of the present invention.

Referring now to FIG. 1, a leg support system 10 of the preferred embodiment is disclosed which may be positioned on a supporting surface 12 and may be configured to support a first leg of a user. The leg support system 10 of the preferred embodiment may be used with a chair 14. The chair 14 may comprise a seatback 16, an armrest 18, and a seat 20. The seat 20 may have an underside 22 and the top side 28. A chair support post 24 with a chair attachment portion 26 may be configured to be attached to the underside 22 of the seat 20 and may contact the supporting surface 12. The chair attachment portion 26 may be detachably affixed to the supporting surface 12. The method of detachably affixing the chair attachment portion 26 to the supporting surface 12 may be accomplished via bolting, strong suction, or the like. One of ordinary skill in the art will appreciate from this disclosure that the chair 14 may be located anywhere in a salon or spa, or anywhere on other vehicles, venues, places, buildings, or other places that seating may be desired, without departing from the scope of the present invention.

Figure 2:
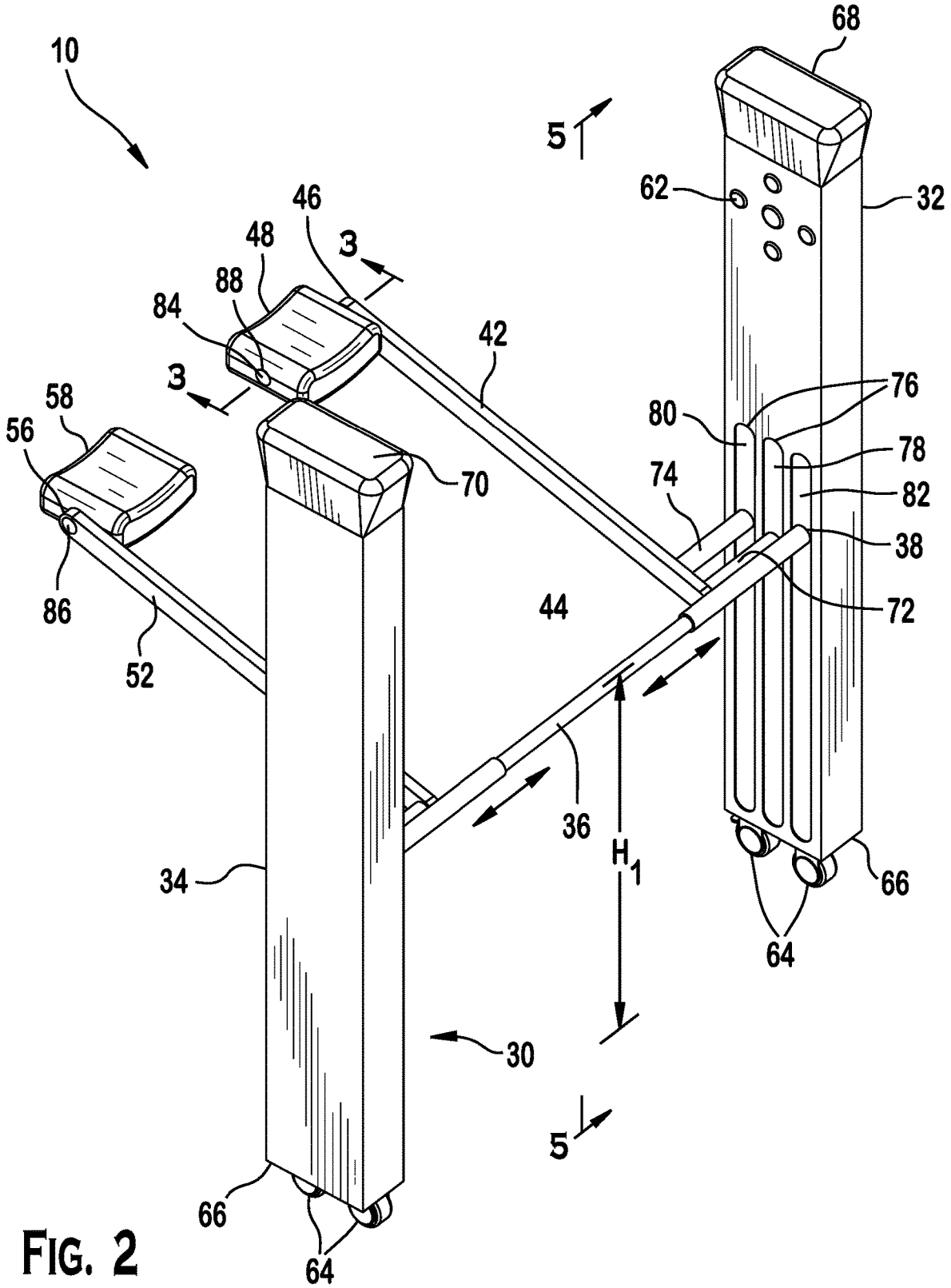
FIG. 2 is a back perspective view of the leg support system 10 of FIG. 1 according to a preferred embodiment of the present invention. This figure illustrates the leg support system 10 when not being used with the chair 14. The leg support system 10 is positioned on a supporting surface 12. The leg support system 10 comprises a housing 30. The housing 30 comprises a first support tower 32, a second support tower 34, and a tower connector 36. The tower connector 36 spans a distance D between the first support tower 32 in the second support tower 34. The tower connector 36 comprises a first support tower connector axial end located adjacent to the first support tower 32 and a second support tower connector axial end 40 located adjacent to the second support tower 34. A first height $H_1$ is measured from the supporting surface 12 to the tower connector 36. The first leg support 42 and a second leg support 52 are also shown. The first leg support 42 comprises a first leg support axial end 44 located toward the first support tower 32 and a first leg support distal end 46 located opposite the first leg support axial end 44. The first leg support distal end 46 is configured to attach to a first leg pad 48. The first leg support axial end 44 is configured to attach to a first drive component 50. The second leg support 52 comprises a second leg support axial end 54 located toward the second support tower 34 and a second leg support distal end 56 located opposite the second leg support axial end 54. The second leg support distal end 56 is configured to attach to a second leg pad 58. The second leg support axial end 54 is configured to attach to a second drive component 60. The first drive component 50 comprises a first rod 72 and a second rod 74. A selectable control 62 is located on an external surface of the first support tower 32.

Referring now to FIG. 2, a leg support system 10 of the preferred embodiment of the present invention is shown. The leg support system 10 may comprise a housing 30. The housing 30 may further comprise a first support tower 32, a second support tower 34, and a tower connector 36. The tower connector 36 may comprise a first support tower connector axial end 38 and the second support tower connector axial end 40. The first support tower connector axial end 38 may be configured to attached to the first support tower 32. The second support tower connector axial end 40 may be configured to attached to the second support tower 34. The tower connector 36 may be shaped like a bar. The tower connector 36 may comprise various segments with varying diameters or sizes such that the tower connector 36 may be able to collapse and/or expand and change the distance D between the first support tower 32 and the second support tower 34. The tower connector 36 connects the first support tower 32 to the second support tower 34. One of ordinary skill in the art will appreciate from this disclosure than any suitable means of creating a telescopic tower connector 36 may be substituted, without departing from the scope of the present invention. Those of ordinary skill in the art will appreciate from this disclosure that the tower connector can have any shape or configuration without departing from the scope of the present invention. For example the tower connector can have a generally trapezoidal cross-sectional shape without departing from the scope of the present invention.

Referring still to FIG. 2, the leg support system 10 may comprise a first leg support 42 and a second leg support 52. The first leg support 42 may comprise a first leg support axial end 44 located adjacent to the first support tower 32 and a first leg support distal end 46 located opposite the first leg support axial end 44. The first leg support axial end 44 may be attached to a first drive component 50. The first drive component 50 may connect the first leg support 42 to the first support tower 32. The second leg support 52 may comprise a second leg support axial end 54 located adjacent to the second support tower 34 and a second leg support distal end 56 located opposite the second leg support axial end 54. The second leg support axial end 54 may be attached to a second drive component 60. The second drive component 60 may connect the second leg support 52 to the second support tower 34. One of ordinary skill in the art will appreciate from this disclosure that when referring to like components, such as the first drive component 50 and the second drive component 60, all possible elements, components, configurations, alternatives, arrangements, and capabilities may be applied from the first component to the like component without departing from the scope of the present invention.

One of ordinary skill in the pertinent art would also appreciate from this disclosure that the first support tower 32 and the second support tower 34 as herein described may be exchanged, switched, or substituted for one another as required or necessitated by any relevant design constraints without departing from the scope of the present invention.

The first and second support tower housings are preferably, but not necessarily have a generally rectilinear cross section when viewed along a cross section generally parallel to the supporting surface. The housings are preferably generally elongated in a direction that is generally perpendicular to the supporting surface. Those of ordinary skill in the art will appreciate from this disclosure that the first and second support tower housings may have any shapes, and even be different from each other, without departing from the scope of the present invention.

Referring still to FIG. 2, the first leg support distal end 46 may be configured to be attached to a first leg pad 48. The first leg pad 48 may form a first fitting hole 88. A first friction fitting 84 may extend from the first leg support distal end 46 and into the first fitting hole 88. The second leg support distal end 56 may be configured to be attached to a second leg pad 58. The second leg pad 58 may form a second fitting hole 90. A second friction fitting 86 may extend from the second leg support distal end 56 and into the second fitting hole 90. One of ordinary skill in the art will appreciate from this disclosure that the connection between the first friction fitting 84 in the first fitting hole 88, and the second friction fitting 86 and the second fitting hole 90, may be any suitable frictional, ratcheted, or otherwise rotationally resistant device capable of allowing the first leg pad 48 and the second leg pad 58 to rotate to a desired position to support the leg of a user and then preferably remain in place while supporting the leg of a user without departing from the scope of the present invention.

Figure 3:
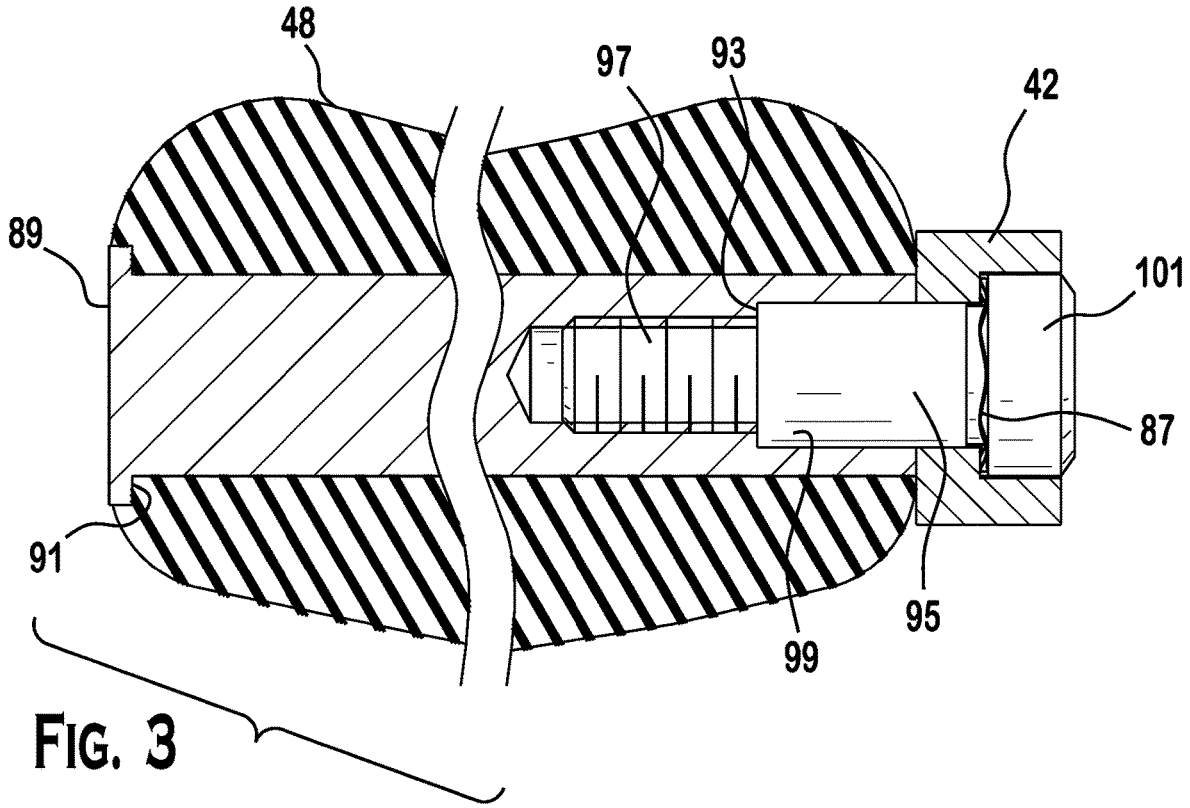
FIG. 3 is a side cross-section of a leg support system 10 of FIG. 2 as taken along the line 3-3 in FIG. 2. This figure illustrates the first leg pad 48. The first leg pad 48 is attached to the first leg support 42 via a shoulder bolt 95. The shoulder bolt 95 enters a pin 89. The shoulder bowl comprises a threaded bolt segment 97, a shoulder creating sleeve 99, and a bolt head 101. The pin 89 comprises a pin shoulder 91 at an end of the first leg pad 48 opposite the shoulder bolt 95. The pin 89 further comprises a pin seating surface 93 designed to accommodate the shoulder creating sleeve 99 of the shoulder bolt 95. A wave washer 87 separates the bolt head 101 from the first leg support 42 and allows for relative rotation between the two components, but also creates friction so that the first leg pad 48 is not allowed to freely rotate.

Referring now to FIG. 3 of the preferred embodiment of the present invention, the first leg pad 48 may be seen in greater detail. The first leg pad 48 may comprise a pin 89 extending therethrough. The pin 89 may comprise a pin shoulder 91 designed to hold the pin 89 from the side opposite the first leg support 42. The pin 89 may further comprise a pin seating surface 93. The first leg pad 48 may be held together with the first leg support 42 via a shoulder bolt 95. The shoulder bolt 95 may extend into the pin 89. The shoulder bolt 95 may comprise a threaded bolt segment 97, a shoulder creating sleeve 99, and a bolt head 101. The shoulder creating sleeve 99 may be designed to fit onto and abut the pin seating surface 93. A wave washer 87 may lie between the bolt head 101 and the first leg support 42. The wave washer 87 may allow for rotation of the first leg pad 48 but increase friction between components thereby preventing free rotation of the first leg pad 48 when undesired. Those of ordinary skill in the art will appreciate from this disclosure that the wave washer can be replaced with a spring washer, regular washer, or any suitable component without departing from the scope of the present invention.

Figure 4:
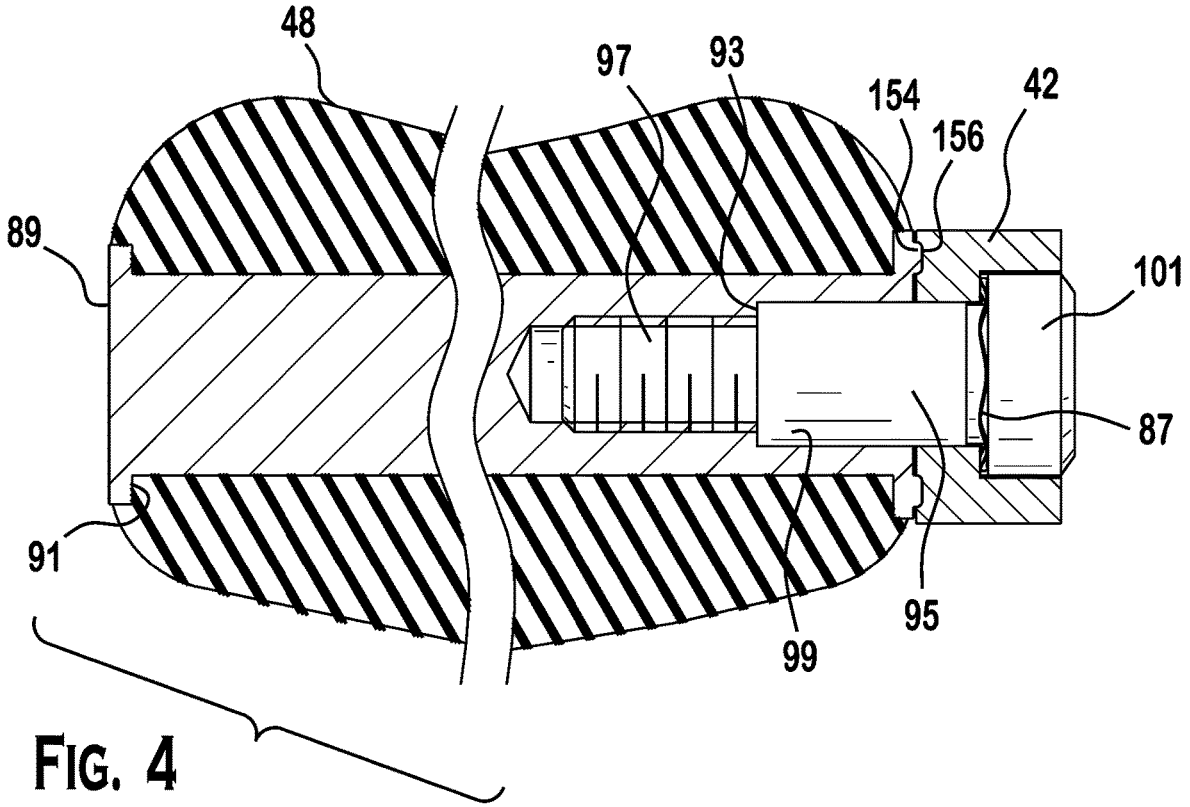
FIG. 4 is a side cross-section of a leg support system 10 similar to that of FIG. 3. This figure illustrates the first leg pad 48. The first leg pad 48 is attached to the first leg support 42 via a shoulder bolt 95. The shoulder bolt 95 enters a pin 89. The shoulder bowl comprises a threaded bolt segment 97, a shoulder creating sleeve 99, and a bolt head 101. The pin 89 comprises a pin shoulder 91 at an end of the first leg pad 48 opposite the shoulder bolt 95. The pin 89 further comprises a pin seating surface 93 designed to accommodate the shoulder creating sleeve 99 of the shoulder bolt 95. A wave washer 87 separates the bolt head 101 from the first leg support 42 and allows for relative rotation between the two components, but also creates friction so that the first leg pad 48 is not allowed to freely rotate. Further, the pin 89 may include an indexing protrusion 154 that extends into a groove 156 of the first leg support 42. The indexing protrusion 154 extending into the groove 156 allows the rotation of the first leg pad 48 to be confined to a predetermined path and also increase the friction between components so as to further restrict free rotation.

Referring now to FIG. 4 of an alternative preferred embodiment of the present invention, the first leg pad 48 may be seen in greater detail. The first leg pad 48 may comprise a pin 89 extending therethrough. The pin 89 may comprise a pin shoulder 91 designed to hold the pin 89 from the side opposite the first leg support 42. The pin 89 may further comprise a pin seating surface 93. The first leg pad 48 may be held together with the first leg support 42 via a shoulder bolt 95. The shoulder bolt 95 may extend into the pin 89. The shoulder bolt 95 may comprise a threaded bolt segment 97, a shoulder creating sleeve 99, and a bolt head 101. The shoulder creating sleeve 99 may be designed to fit onto and abut the pin seating surface 93. A wave washer 87 may lie between the bolt head 101 and the first leg support 42. The wave washer 87 may allow for rotation of the first leg pad 48 but increase friction between components thereby preventing free rotation of the first leg pad 48 when undesired. Further, an indexing protrusion 154 may extend from the pin 89 into a corresponding groove 156 defined by the first leg support 42. The indexing protrusion extending 154 into the groove 156 may allow the rotation of the first leg pad 48 to follow a predetermined path while simultaneously increasing the friction between components to further inhibit free rotation of the first leg pad 48 when undesired. Those of ordinary skill in the art will appreciate from this disclosure that any suitable leg pad and/or leg pad attachment mechanism can be used without departing from the scope of the present invention.

Figure 5:
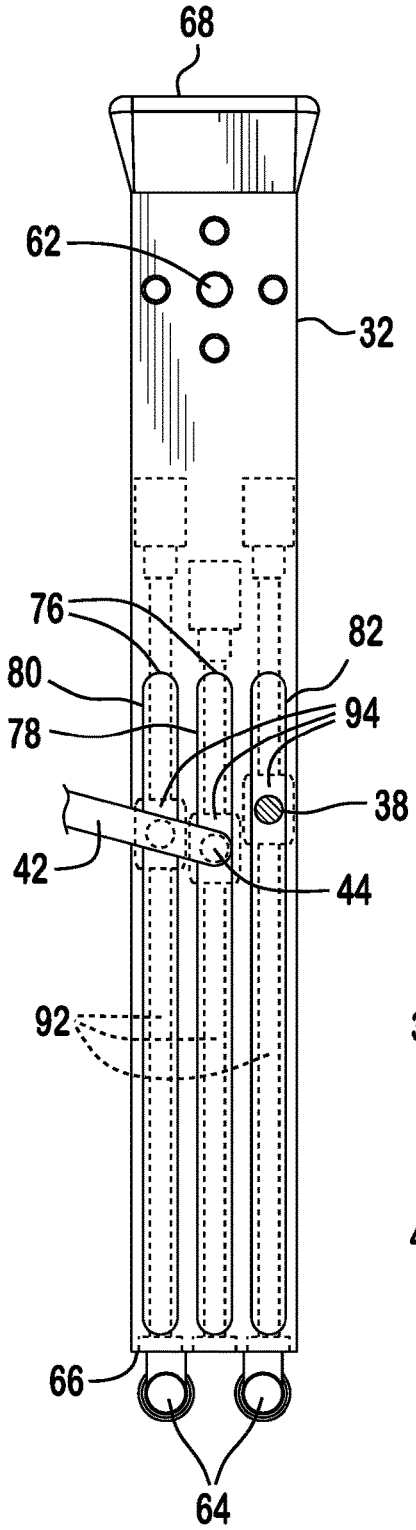
FIG. 5 is a partial, cut-away side view of a leg support system 10 in the preferred embodiment. The leg support system 10 comprises a first elevator mechanism 100. Here, the first elevator mechanism 100 is shown contained within the first support tower 32. The first support tower 32 comprises at least one drive component slot 76 and at least one tower connector slot 82. The at least one drive component slot 76 further comprises a first drive component slot 78 and a second drive component slot 80. The first elevator mechanism 100 comprises a plurality of threaded rods 92 and a plurality of writing elements 94.

Referring still to FIG. 5 of the preferred embodiment of the present invention, the first support tower 32 may comprise at least one drive component slot 76 and at least one tower connector slot 82. The at least one drive component slot 76 may further comprise a first drive component slot 78 and a second drive component slot 80. The leg support system 10 may also comprise a first elevator mechanism 100 located in the first support tower 32. The at least one drive component slot 76 may be configured to allow attachment of the first drive component 50 to the first elevator mechanism 100. The at least one tower connector slot 82 may be configured to allow attachment of the tower connector 36 to the first elevator mechanism 100. The first drive component slot 78 may be configured to allow the first rod 72 to connect to the first elevator mechanism 100. The second drive component slot 80 may be configured to allow the second rod 74 to connect to the first elevator mechanism 100.

Still referring to FIG. 5 of the preferred embodiment of the present invention, a selectable control 62 may be positioned on an external surface of the first part tower 32. The selectable control 62 may be in communication with the first elevator mechanism 100 and may be configured to activate the first elevator mechanism 100. The selectable control 62 may be in an activated state when it is being used to control the first elevator mechanism 100. When the user activates the selectable control 62, the user may engage the first elevator mechanism 100 to set the tower connector 36 at a first height $H_1$ where the tower connector 36 may contact the underside 22 of a chair 14, locking the leg support system 10 into position with the chair 14. The user may also activate the selectable control 62, engaging the first elevator mechanism 100, to set the first leg support 42 at a second height $H_2$ and at an angle θ that is comfortable for supporting the first leg of the user.

Still referring to FIG. 5 of the preferred embodiment of the present invention, a plurality of the threaded rods 92 may be generally perpendicular to the supporting surface. The plurality of the threaded rods 92 being generally perpendicular to the supporting surface 12 preferably means that the plurality of threaded rods 92 form an angle at the bottom 108 with the supporting surface 12 of no less than 45° (fourty-five degrees). More preferably, the plurality of the threaded rods 92 being generally perpendicular to the supporting surface 12 means that the plurality of threaded rods 92 form an angle at the bottom 108 with the supporting surface 12 of no less than 60° (sixty degrees). More preferably still, the plurality of the threaded rods 92 being generally perpendicular to the supporting surface 12 means that the plurality of threaded rods 92 form an angle at the bottom 108 with the supporting surface 12 of no less than 80° (eighty degrees). Most preferably, the plurality of the threaded rods 92 being generally perpendicular to the supporting surface 12 means that the plurality of threaded rods 92 form an angle at the bottom 108 with the supporting surface 12 of 90° (ninety degrees).

Figure 6:
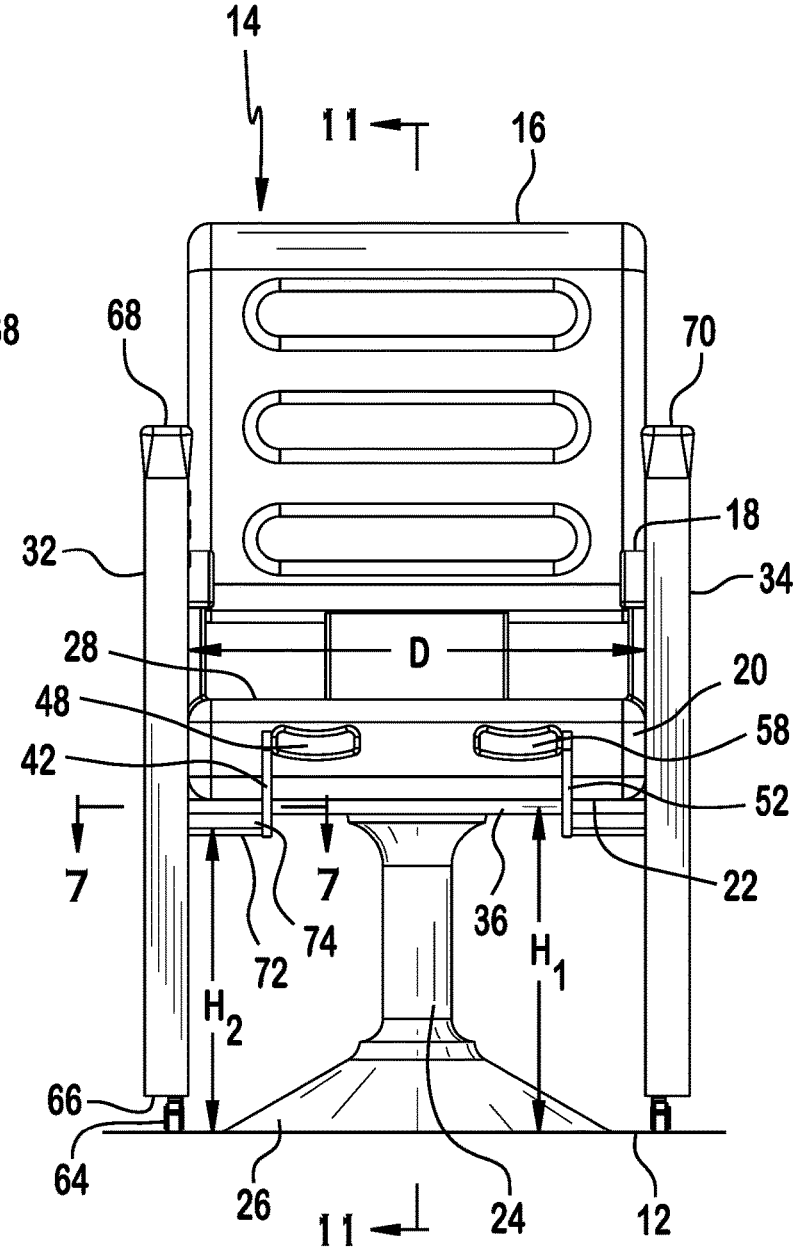
FIG. 6 is a front view of the leg support system 10 of FIG. 1 according to the preferred embodiment of the present invention. This figure illustrates a distance D between the first support tower 32 and the second support tower 34. Also, a first height $H_1$ can be seen as measured from the supporting surface 12 to the tower connector 36, and a second height $H_2$ can be seen as measured from the supporting surface 12 to the first drive component 50. The first support tower 32 and the second support tower 34 comprise a first support tower cap 68 and a second support tower cap 70, respectively. Each of the first support tower 32 and the second support tower 34 further comprise distal ends 66. The distal ends 66 are configured to attach to a plurality of wheels 64. The plurality of wheels 64 being configured to contact the supporting surface 12.

Referring now to FIG. 6 of the present invention, the leg support system 10 may be seen engaged with a chair 14. FIG. 6 illustrates the distance D between the first support tower support 32 and the second support tower support 34. This figure also illustrates the first height $H_1$ as measured from the supporting surface 12 to the tower connector 36, and the second height $H_2$ as measured from the supporting surface 12 to the first drive component 50. The first support tower support 32 may comprise a first support tower cap 68 located at the top and the second support tower support 34 may comprise a second support tower cap 70 located at the top. One of ordinary skill in the art will appreciate from this disclosure that the first and second support tower caps 68, 70 may preferably be constructed of any suitably comfortable and grippable material without departing from the scope of the present disclosure.

Still referring to FIG. 6, the first support tower 32 and the second support tower 34 may comprise distal ends 66. The distal end 66 may be configured for placement closest to the supporting surface 12. Each of the distal ends 66 may also have a plurality of wheels 64 disposed thereon which may be configured to contact the supporting surface 12. One of ordinary skill in the art will appreciate that the supporting surface 12 may be the ground or any other suitably stable solid surface without departing from the scope of this disclosure.

Figure 7:
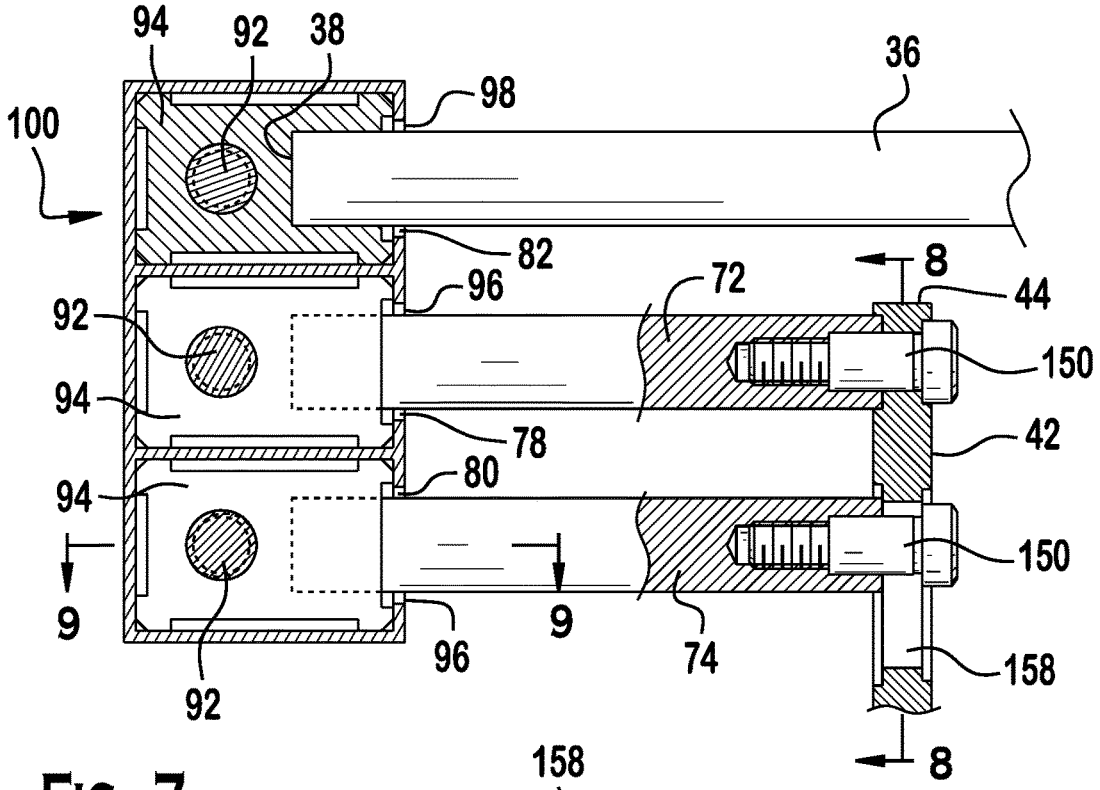
FIG. 7 is a partially cut away, cross-sectional view of the leg support system 10 of FIG. 6 as taken along the line 7-7 in FIG. 6. Here, it can be seen that the first elevator mechanism 100 comprises a plurality of threaded rods 92 and a plurality of riding elements 94. The plurality of threaded rods 92 and the plurality of riding elements 94 are contained within the first support tower 32. The plurality of riding elements 94 attach to the tower connector 36 at the first support tower connector axial end 38. The plurality of riding elements 94 also attach to the first leg support 42 via the first rod 72 and the second rod 74 of the first drive component 50. The at least one drive component slot 76 further comprises an edge of the at least one drive component slot 96. The edge of the at least one drive component slot 96 is configured to contact the first drive component 50. The at least one tower connector slot 82 comprises an edge of the at least one tower connector slot 98. The edge of the at least one tower connector slot 98 is configured to contact the tower connector 36. This figure further illustrates how the first rod 72 and the second rod 72 are attached to the first leg support 42 via bolts 150.

Now referring to FIG. 7 of the preferred embodiment of the present invention, the first elevator mechanism 100 may comprise a plurality of threaded rods 92 and a plurality of riding elements 94 disposed thereon. The plurality of riding elements 94 may be located within the first support tower 32. The plurality of riding elements 94 may have threaded holes to receive the threaded rods 92. The plurality of riding elements 94 may connect to the tower connector 36, the first rod 72 and the second rod 74. Each of the plurality of riding elements 94 may move independently of one another. In order for the riding elements 94 to move up or down within the first support tower 32, the corresponding threaded rod 92 must turn due to the elevator mechanism 100. The at least one drive component slot 76 may have an edge of the at least one drive component slot 96. The at least one tower connector slot 82 may have an edge of the at least one tower connector slot 98. The first drive component 50 may contact the edge of the at least one drive component slot 96 and may be prevented from rotating. The tower connector 36 may contact the edge of the at least one tower connector slot 98 and may be prevented from rotating. Because the first drive component 50 and the tower connector 36 may be prevented from rotating due to the contact with the edges 96, 98, the plurality of riding elements 94 must move up or down depending on the direction of rotation of the plurality of threaded rods 92. This in turn may raise or lower the first drive component 50 or the tower connector 36. Each of the tower connector 36, the first rod 72, and the second rod 74 may be raised or lowered independently of one another.

One of ordinary skill in the art will appreciate from this disclosure that the first elevator mechanism 100 may be replaced or substituted by any other suitable mechanism, device, or apparatus for raising or lowering components such as a pulley system, chain and gear system, or other movement system without departing from the scope of the present invention.

Figure 8:
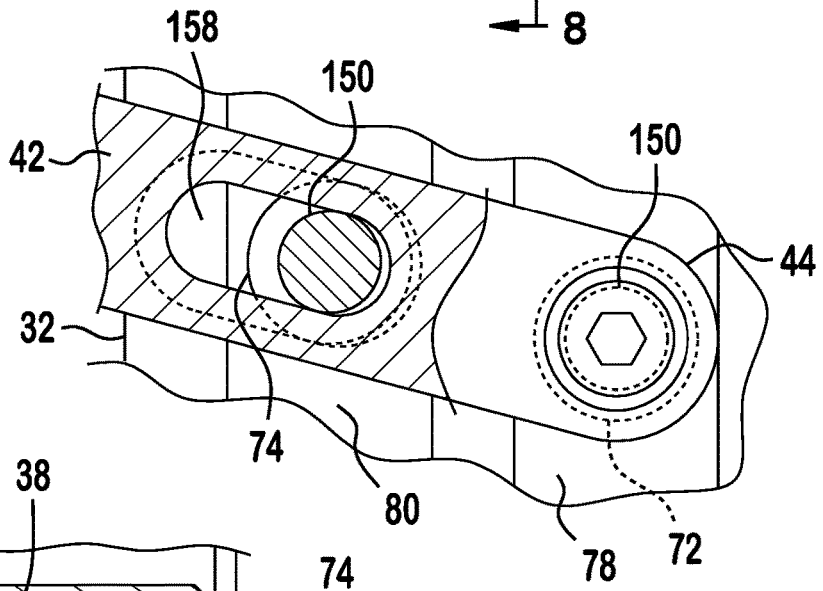
FIG. 8 is a cross-sectional view of the leg support 42 of FIG. 7 as taken along the line 8-8 in FIG. 7. Here, a first drive component 50 may be seen. The first drive component 50 comprises a first rod 72 and a second rod 74. The first leg support 42 defines a track 158 there along. A bolts 150 affixing the second rod 74 to the first leg support 42 extends through the track 158. The track 158 allows the second rod 74 to move axially along the first leg support 42 as a distance between the first rod 72 and the second rod 74 changes due to adjustment by the user.

Referring now to FIG. 8 of the preferred embodiment of the present invention, the first drive component 50 may be seen in engagement with the first leg support 42. The first leg support 42 may define a track 158 for the second rod 74 to travel axially therealong. A bolt 150 may connect the first rod 72 and the second rod 74 to the first leg support 42. The shoulder bolt 150 holding the second rod 74 to the first leg support 42 may extend through the track 158. Because the first rod 72 and the second rod 74 may be raised or lowered independently of one another by the first elevator mechanism 100, the track 158 allows for the distance between the first rod 72 and the second rod 74 to change as the angle θ of the first leg support 42 changes.

Figure 9:
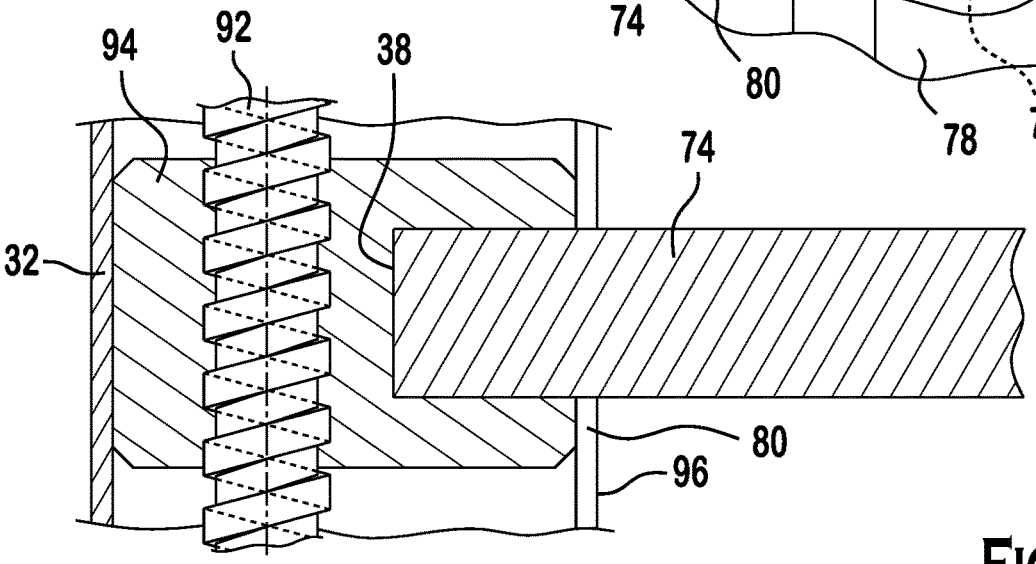
FIG. 9 is a partial, front cross-sectional view of a leg support system 10 of FIG. 7 as taken along the line 9-9 in FIG. 7. Here, it can be seen that the plurality of threaded rods 92 extend through the plurality of riding elements 94. As the plurality of threaded rods 92 of the first elevator mechanism 100 rotate through the corresponding plurality of riding elements 94, the contact between the first drive component 50 and the edge of the at least one drive component slot 96 prevents the full rotation of the drive component 50 around the plurality of threaded rods 92, and instead forces the plurality of riding elements 94 up or down depending on the direction of rotation.

Referring now to FIG. 9 of the preferred embodiment of the present invention, one of the plurality of threaded rods 92 may be seen in greater detail. The one of the plurality of threaded rods 92 may be seen engaged with one of the plurality of riding elements 94 via a threaded hole therein. The first drive component 50 may be seen engaged with the one of the plurality of riding elements 94. The one of the plurality of riding elements 94 is preferably contained wholly within the first support tower 32. It is preferable, but not necessary, that only the first drive component 50 contacts the edge of the at least one drive component slot 96 and extends therefrom.

Figure 10:
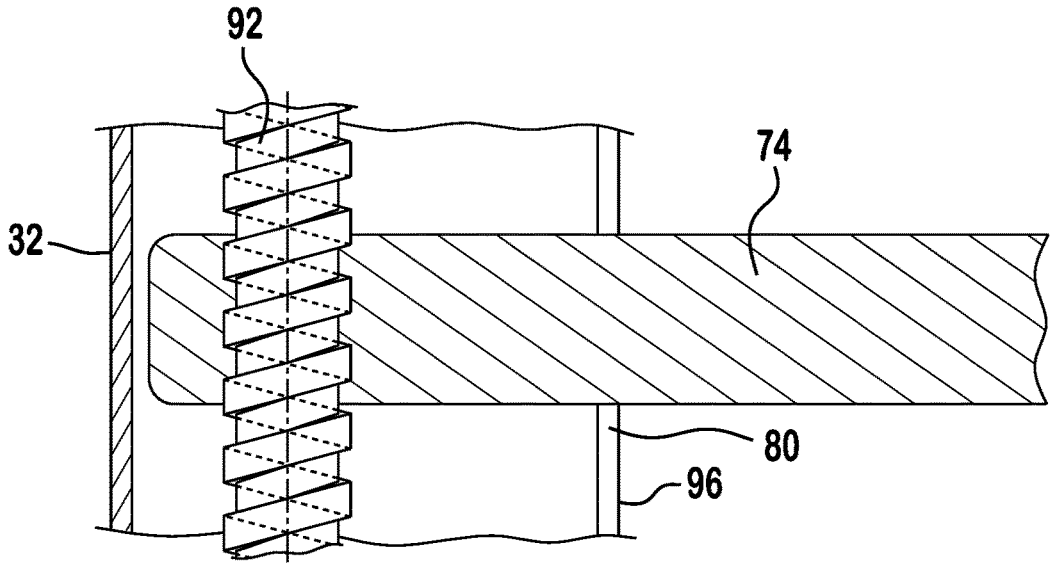
FIG. 10 is an alternative embodiment of the leg support 10 shown in a partial, front cross-sectional view of a leg support system 10 similar to that of FIG. 9. Here, it can be seen that the plurality of threaded rods 92 extend directly through the first drive component 50. As the plurality of threaded rods 92 of the first elevator mechanism 100 rotate through the corresponding first drive component 50, the contact between the first drive component 50 and the edge of the at least one drive component slot 96 prevents the full rotation of the drive component 50 around the plurality of threaded rods 92, and instead forces the first drive component 50 up or down depending on the direction of rotation.

Referring now to FIG. 10 of an alternative preferred embodiment of the present invention, one of the plurality of threaded rods 92 may be seen in greater detail. The one of the plurality of threaded rods 92 may be seen engaged with the first drive component 50 directly. Here, the first drive component 50 may have a threaded hole in order to be directly engaged with one of the plurality of threaded rods 92. It is preferable that only the first drive component 50 contacts the edge of the at least one drive component slot 96 and extends therefrom.

Figure 11:
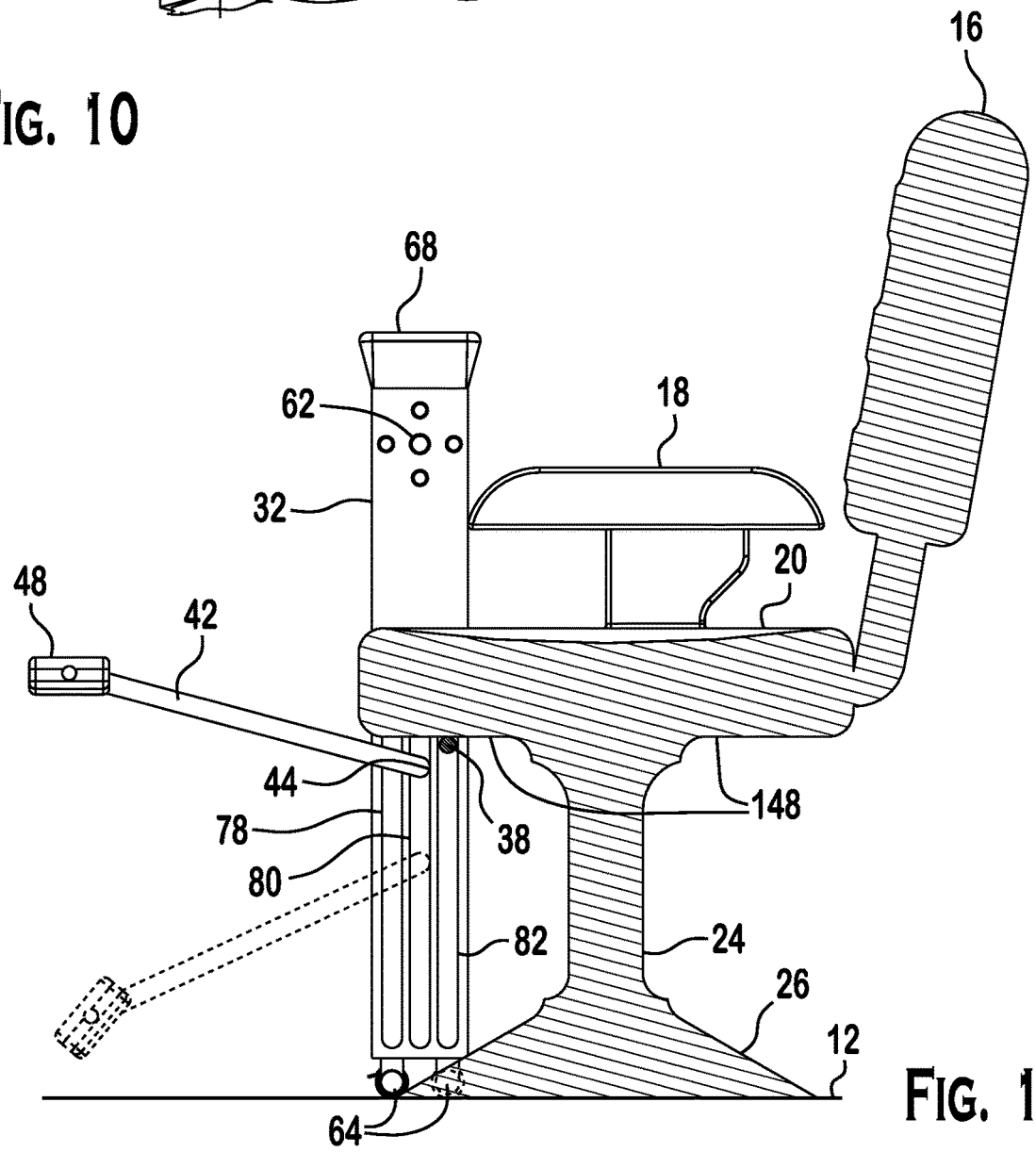
FIG. 11 is a side cross-sectional view of the leg support system 10 of FIG. 6 as taken along the line 11-11 in FIG. 6. Here, it can be seen that both the second height $H_2$ and the angle θ of the first leg support 42 may be adjusted by the user of the chair 14. The angle θ corresponds to the angle between the first leg support 42 and the first support tower 32. The chair 14 having an underside 22 may also have a portion of the underside of the chair 148.

Referring now to FIG. 11 of a preferred embodiment of the present invention, the first leg support 42 may be seen after both the second height $H_2$ and the angle θ may have been adjusted by a user. The angle θ may be measured from the first leg support 42 to the front of the first support tower 32.

Figure 12:
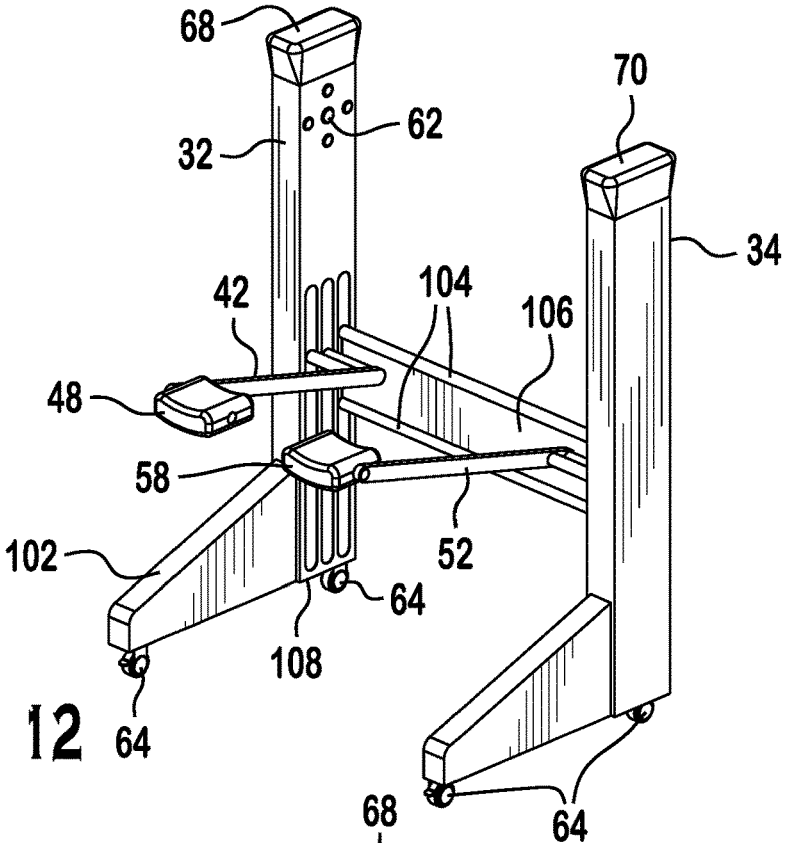
FIG. 12 is a front perspective view of an alternative embodiment of a leg support system 10 according to the present invention. Here, a first strut 102 may be seen extending from a bottom 108 of the first support tower 32. The first strut 102 may accommodate the plurality of wheels 64. The first strut 102 contacts the supporting surface 12 and prevents pivoting of the leg support system 10 about the bottom 108 of the first support tower 32. The tower connector 36 comprises two crossbars 104. Between the two crossbars 104, the tower connector 36 further comprises a plate 106 to provide extra rigidity to the tower connector 36.
Figure 13:
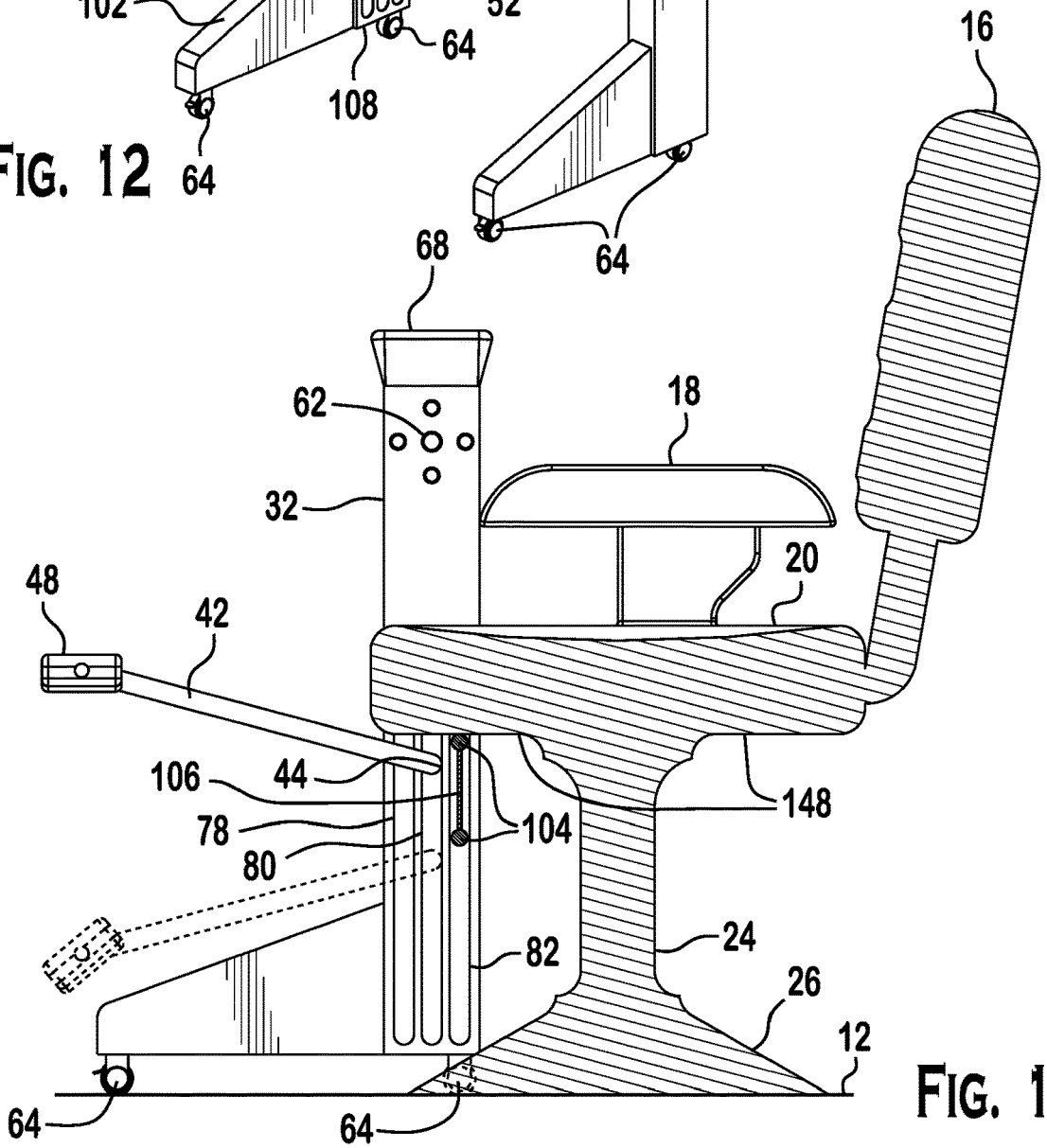
FIG. 13 a side cross-sectional view of the leg support system 10 of FIG. 12 positioned with a chair in a similar fashion to that shown in FIG. 11. Here, a first strut 102 may be seen extending from a bottom 108 of the first support tower 32. The first strut 102 may accommodate the plurality of wheels 64. The first strut 102 contacts the supporting surface 12 and prevents pivoting of the leg support system 10 about the bottom 108 of the first support tower 32. The tower connector 36 comprises two crossbars 104. Between the two crossbars 104, the tower connector 36 further comprises a plate 106 to provide extra rigidity to the tower connector 36.

Referring now to FIGS. 12 and 13 of the alternative preferred embodiment of the present invention, the leg support system 10 may comprise a tower connector 36. The tower connector 36 may comprise two or more crossbars 104 (or other connective structures) with a plate 106 (or other housing component) therebetween. The two crossbars 104 with the plate 106 therebetween may contribute to high rigidity and stability of the leg support system 10. Additionally, the leg support system 10 may comprise a first strut 102 extending from a bottom 108 of the first support tower 32. The first strut 102 may increase the surface area of the bottom 108 of the first support tower 32 and may increase the overall rigidity and stability of the leg support system 10. The first strut 102 may also provide the housing 30 with extra resistance to pivoting about the bottom 108 of the first support tower 32 and the second support tower 34. The two crossbars 104 with the plate 106 therebetween may all be contained within the at least one tower connector slot 82.

Referring now to FIGS. 14-17 which illustrate an alternative preferred embodiment of the present invention, the leg support system 10 may comprise a tower connector 36. The tower connector 36 may further comprise a wing plate 110. Preferably the tower connector 36 may comprise two wing plates 110. The wing plate 110 may connect to the tower connector 36 at a hinge 120. Those of ordinary skill in the art will appreciate from this disclosure that any other connector or connector mechanism can be used between the wing plate(s) and the tower connector 36 without departing from the scope of the present invention.

Figures 14, 15:
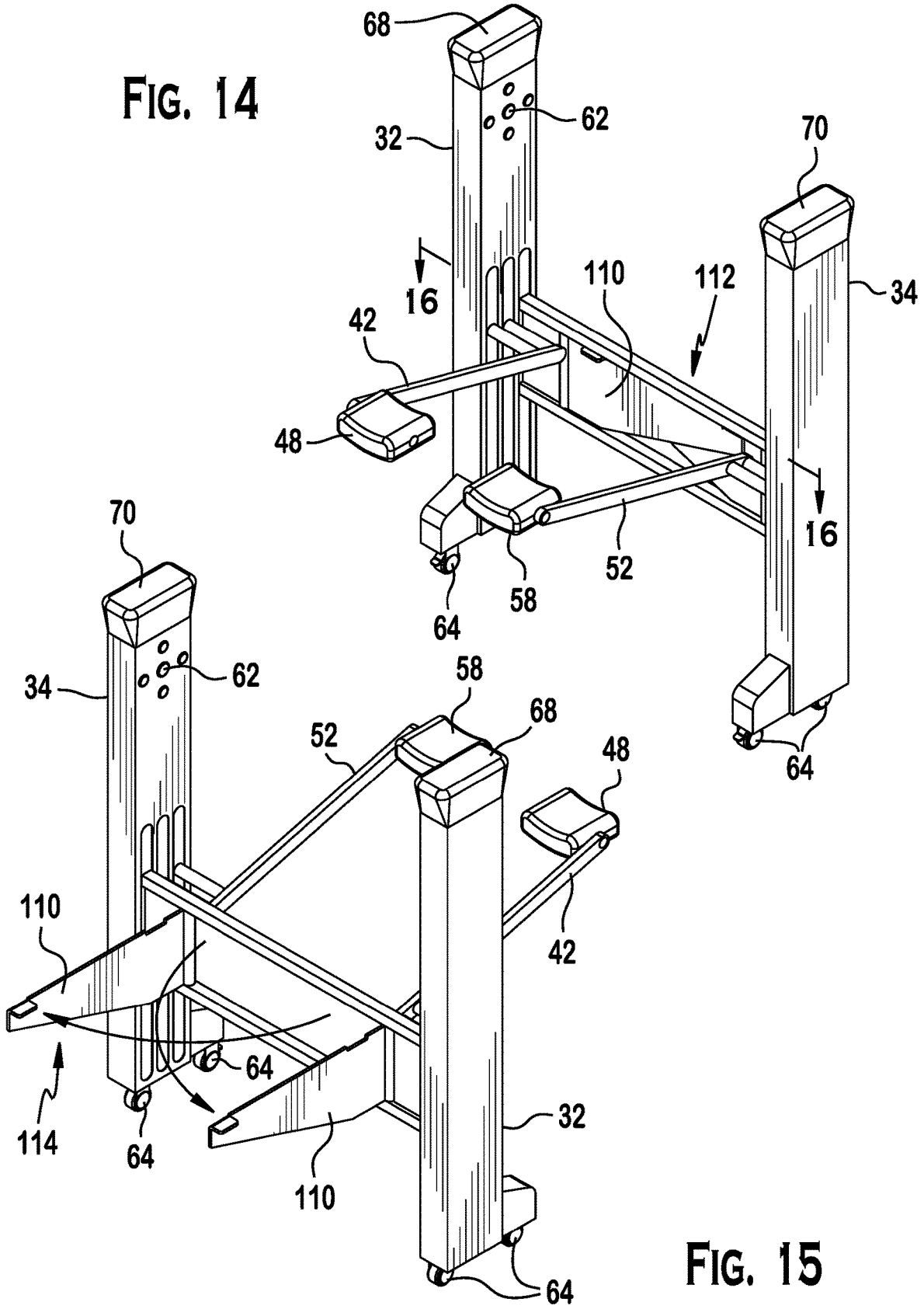
FIG. 14 is a front perspective view of a leg support system 10 according to an alternative embodiment of the present invention. In this embodiment, a tower connector 36 comprises a wing plate 110. Here, the wing plate 110 can be seen in a first, folded position 112. When the wing plate 110 is in the first, folded position 112, wing plate 110 is generally parallel to the tower connector 36. Also, a first friction fitting 84 and a second friction fitting 86 can be seen located on the first leg support distal end 46 and the second leg support distal end 56, respectively. The first friction fitting 84 and the second friction fitting 86 extend into the first fitting hole 88 of the first leg pad 48 and the second fitting hole 90 of the second leg pad 58, respectively.
FIG. 15 is a back perspective view of the leg support system 10 of FIG. 14. A tower connector 36 comprises a wing plate 110. Here, the wing plate 110 can be seen in a second, extended position 114. The wing plate 110 may comprise a first wing plate 110*a* and a second wing plate 110*b*. When the wing plate 110 is in the second, extended position 114, the wing plate 110 extends outwardly and away from the tower connector 36 to contact a portion of the underside of a chair 148. The wing plate 110 comprises a wing tab 116. The wing plate 110 further comprises a wing tab receiver configured to receive the wing tab when the wing plate 110 is converted from the second, extended position 114 to the first, folded position 112.
Figure 16:
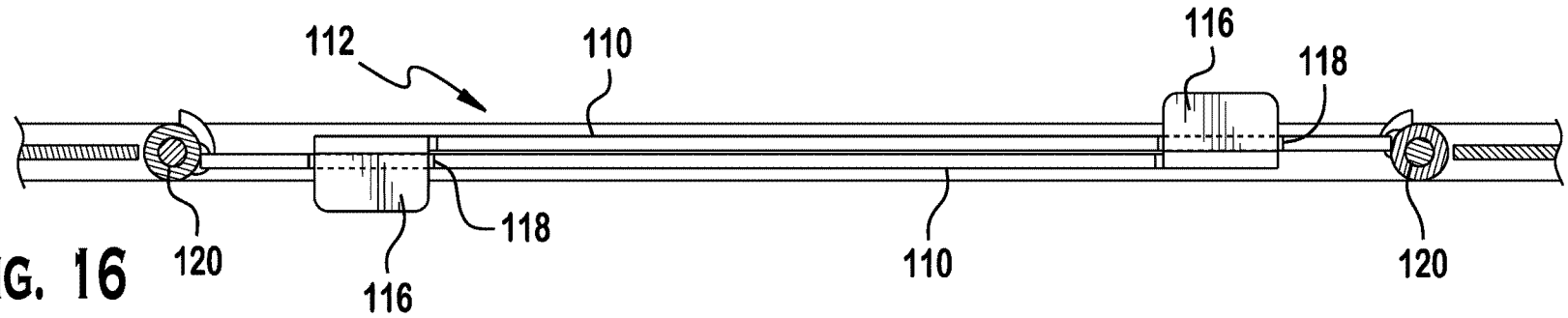
FIG. 16 is a partial, cut-away cross-sectional view of the leg support system 10 of FIG. 14 as taken along the lines 16-16 in FIG. 14. Here, the tower connector 36 can be seen comprising the wing plate 110 in the first, folded position 112. The wing plate 110 comprises wing tabs on 116 partially accommodated by the wing tab receivers 118. The wing plate 110 is generally parallel to the tower connector 36. Hinges 120 connect the wing plate 110 to the tower connector 36.

Referring specifically to FIGS. 14 and 16, the wing plate 110 may be in a first, folded position 112. When the wing plate 110 is in the first, folded position 112, the wing plate 110 may be generally parallel to the tower connector 36. The wing plate 110 being generally parallel to the tower connector 36 preferably means that the wing plate 110 forms an angle at the hinge 120 with the tower connector 36 of no more than 45° (fourty-five degrees). More preferably, the wing plate 110 being generally parallel to the tower connector 36 means that the wing plate 110 forms an angle at the hinge 120 with the tower connector 36 of no more than 30° (thirty degrees). More preferably still, the wing plate 110 being generally parallel to the tower connector 36 means that the wing plate 110 forms an angle at the hinge 120 with the tower connector 36 of no more than 10° (ten degrees). Most preferably, the wing plate 110 being generally parallel to the tower connector 36 means that the wing plate 110 forms an angle at the hinge 120 with the tower connector 36 of 0° (zero degrees).

Figure 17:
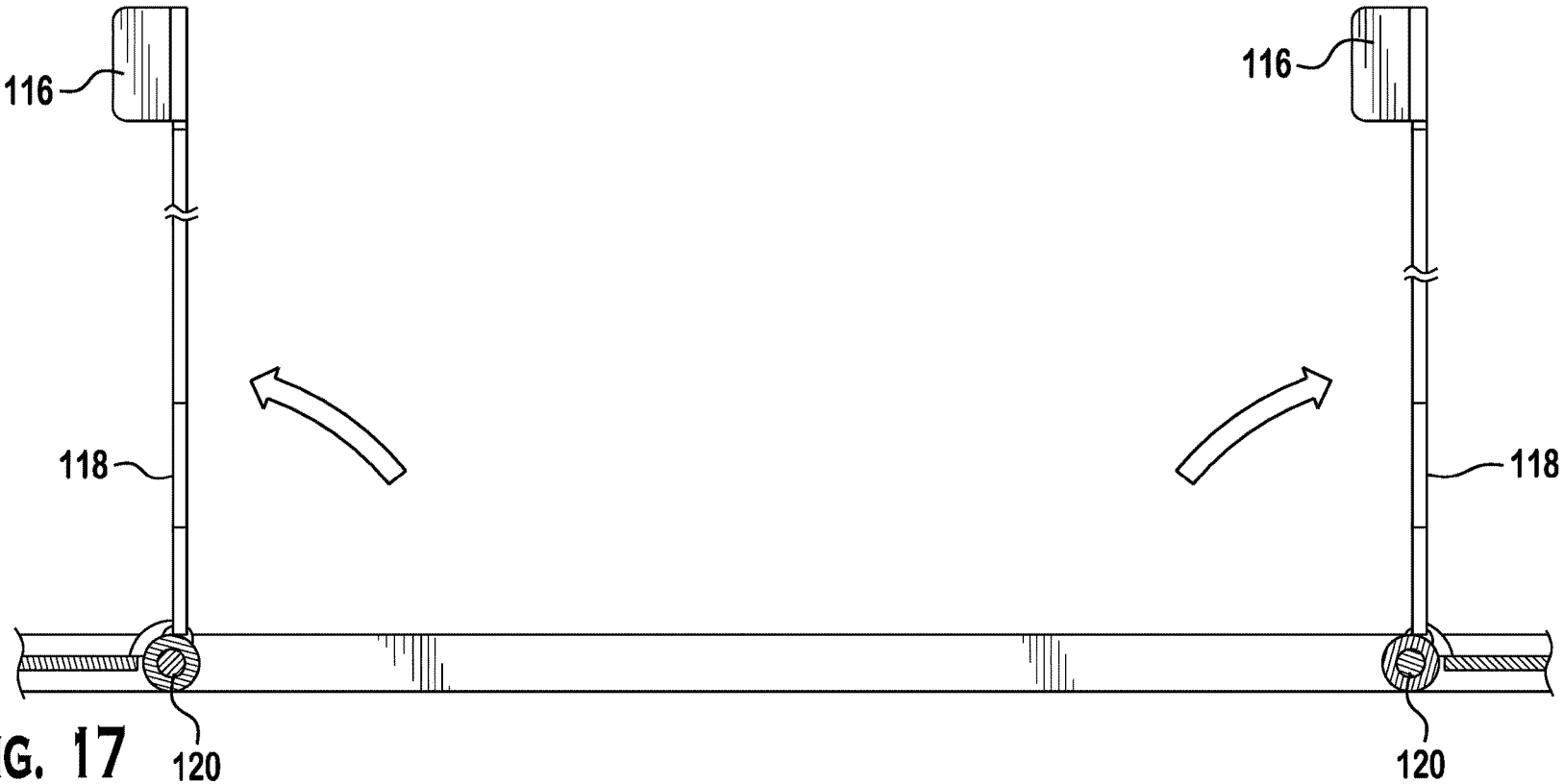
FIG. 17 is a partial, cut-away cross-sectional view of the leg assembly in FIG. 17 shown in a similar fashion to that of FIG. 16. Here, the tower connector 36 can be seen comprising the wing plate 110 in the second, extended position 114. The wing plate 110 comprises wing tabs on 116 partially accommodated by the wing tab receivers 118. The wing plate 110 extends outwardly from the tower connector 36. Hinges 120 connect the wing plate 110 to the tower connector 36. The hinges 120 allow the wing plate to move from the first, folded position 112 to the second, extended position 114 and back again.

Referring specifically to FIGS. 15 and 17, the wing plate 110 may comprise a wing tab 116 and a wing tab receiver 118. The wing plate 110 may further comprise a first wing plate 110*a* and a second wing plate 110*b*. The wing plates 110*a*, 110*b*, as depicted, may be in a second, extended position 114 where the first and second wing plates 110*a*, 110*b* extend outwardly from the tower connector 36 to contact a portion of the underside of the chair 148. Preferably, the wing tab 116 of the first wing plate 110*a* may correspond and enter the wing tab receiver 118 of the second wing plate 110*b*, and the wing tab 116 of the second wing plate 110*b* may correspond and enter the wing tab receiver 118 of the first wing plate 110*a*, when the two wing plates 110*a*, 110*b* are moved from the second, extended position 114 to the first, folded position 112. One of ordinary skill in the art will appreciate from this disclosure that the use of one wing plate 110 may be preferred in certain configurations without departing from the scope of the present invention. The purpose of the wing plate 110 in the second, extended position 114 contacting the portion of the underside of the chair 148 may be to increase the support and stability of the leg support system 10 when in use with a chair 14.

Figure 18:
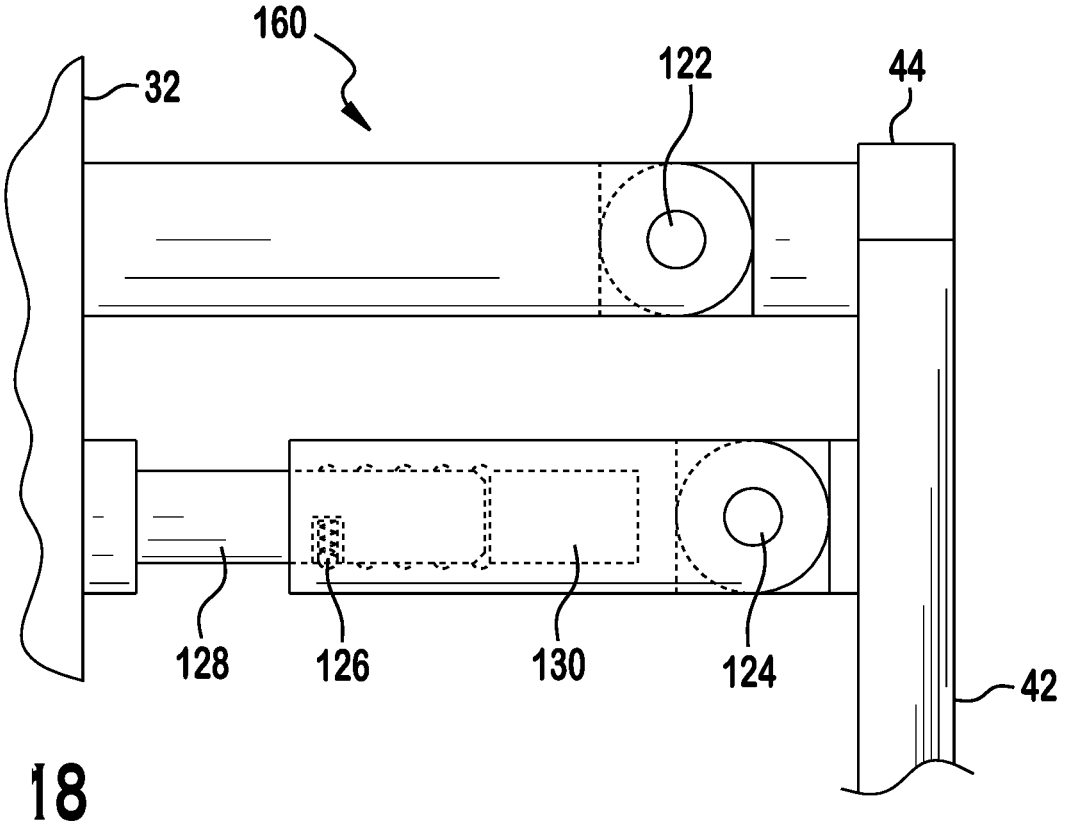
FIG. 18 is a top view of a first drive component 50 of an alternative preferred embodiment of the leg assembly 10 of the present invention. This figure illustrates the first drive component 50 comprising a first rod 72 and a second rod 74. The first rod 72 comprises a first joint 122. The second rod 74 comprises a second joint 124. The second rod 74 further comprises a second rod male portion 128 extending into a second rod female portion 130 which is detachably affixed via a detent pin 126. The first drive component 50 is shown in a straight position 160.
Figure 19:
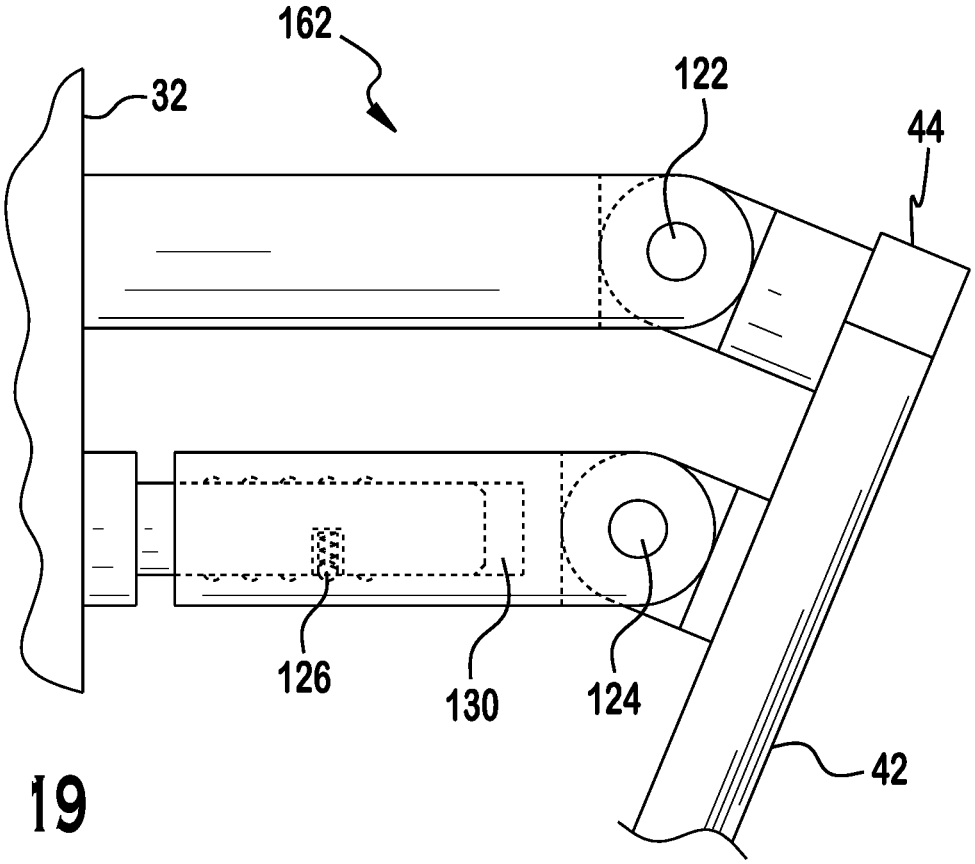
FIG. 19 is a view similar to that of FIG. 18 illustrating the drive component in an alternate position. This figure illustrates the first drive component 50 comprising a first rod 72 and a second rod 74. The first rod 72 comprises a first joint 122. The second rod 74 comprises a second joint 124. The second rod 74 further comprises a second rod male portion 128 extending into a second rod female portion 130 which is detachably affixed via a detent pin 126. The first drive component 50 is shown in a flexed position 162.

Referring now to FIGS. 18 and 19 of the alternative preferred embodiment of the present invention, the first drive component 50 may be seen comprising a first joint 122 located on the first rod 72 and a second joint 124 located on the second rod 74. The first joint 122 and the second joint 124 may allow for angular repositioning of the first leg support 42 toward or away from the first support tower 32. The second rod 74 may comprise a second rod male portion 128 with a detent pin 126 extending from the first support tower 32 side into a second rod female portion 130 extending from the second joint 124 side. The purpose of the second rod male portion 128 and the second rod female portion 130 may be to allow the length of the second rod 74 to change. Specifically, FIG. 18 may depict the first drive component 50 in a straight position 160. However, FIG. 19 may depict the first drive component 50 in a flex position 162. For the first drive component 50 to be converted from a straight position 160 a flex position 162, the length of the second rod 74 may have to change relative to the length of the first rod 72.

Figure 20:
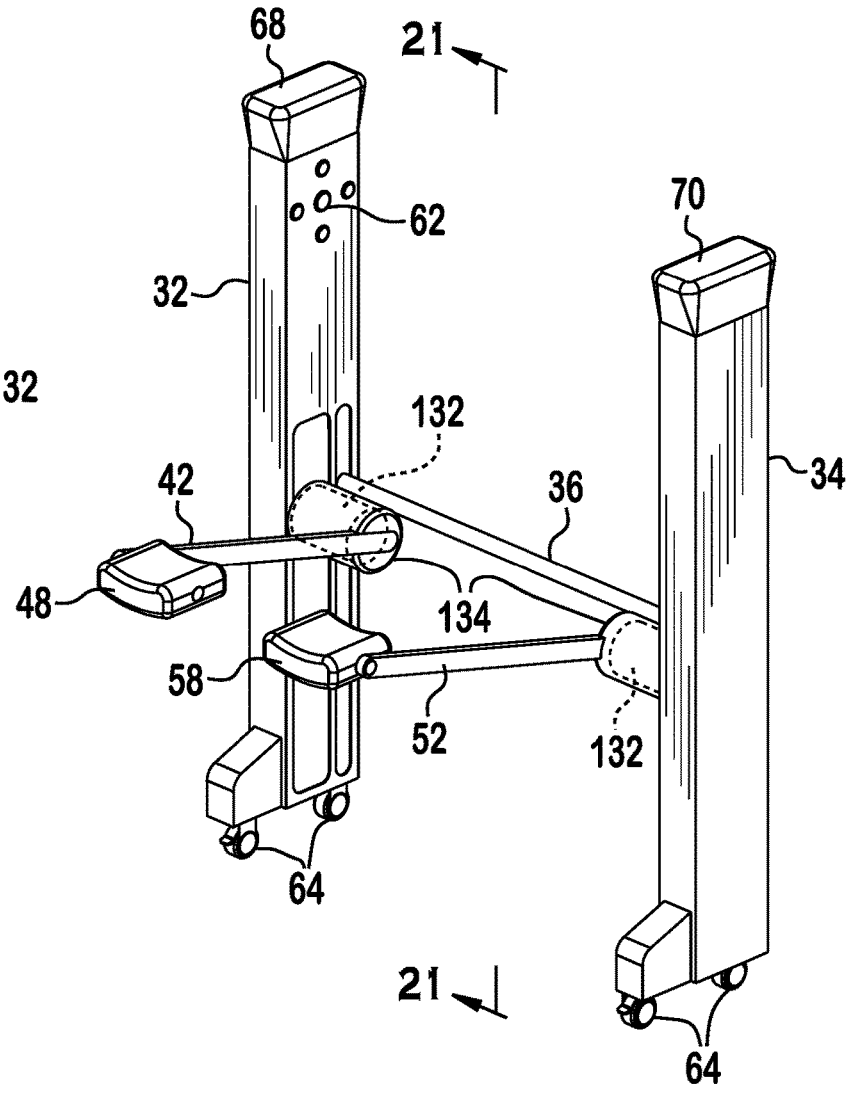
FIG. 20 is a front perspective view of a leg support system 10 according to an alternative preferred embodiment of the present invention. Here, a first drive component 50 of the leg support system 10 comprises a motor 132. The motor 132 can be engaged by the selectable control 62, and via a drive housing 134, the angle θ of the first leg support 42 may be adjusted.
Figure 21:
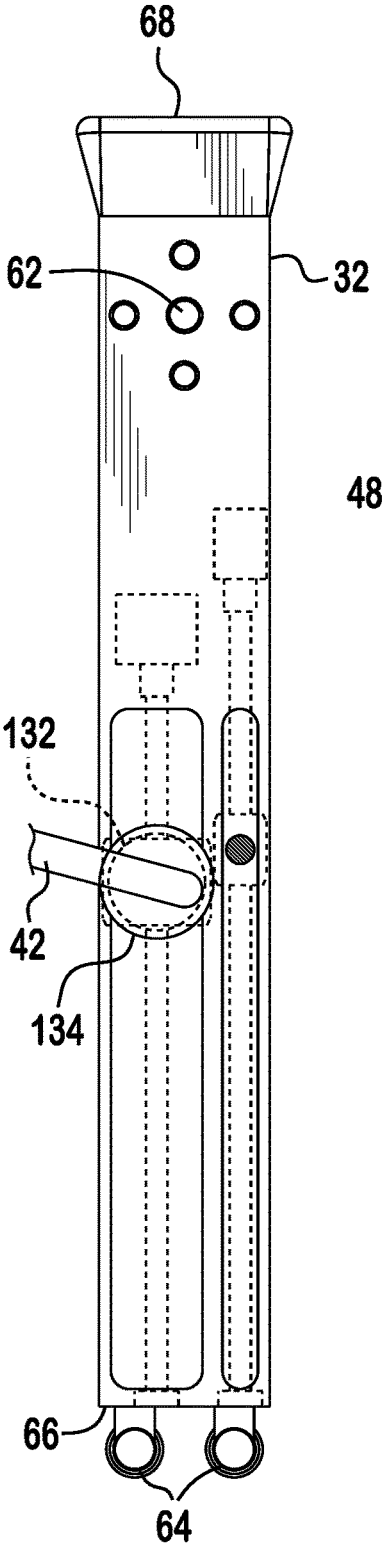
FIG. 21 is a partial, cross-sectional view of a leg support system 10 of FIG. 20 as taken along the lines 21-21 in FIG. 20. The leg support system 10 comprises a first elevator mechanism 100. Here, the first elevator mechanism 100 is shown contained within the first support tower 32. A first drive component 50 of the leg support system 10 comprises a motor 132. The motor 132 can be engaged by the selectable control 62, and via a drive housing 134, the angle θ of the first leg support 42 may be adjusted.

Referring now to FIGS. 20 and 21 of an alternative preferred embodiment of the present invention, the first drive component 50 comprises a drive housing 134 enclosing a motor 132. The drive housing 134 may be engaged with the first elevator mechanism 100 through the at least one drive component slot 76. In this configuration, the first elevator mechanism 100 may be able to adjust the second height $H_2$ of the first leg support 42 and the motor 132 may be able to adjust the angle θ of the first leg support 42 without the need for a second rod 74. One of ordinary skill in the art will appreciate from this disclosure that any suitable electrical, mechanical, or magnetic device may be substituted for the motor 132 without departing from the scope of the present invention.

Referring now generally to FIGS. 22-27 of the alternative preferred embodiment of the present invention, the tower connector 36 may comprise an upper portion 140 further defining a flange 142. The underside 22 of the seat 20 may comprise a bracket 136 further defining a channel 138. Now, when the tower connector 36 is raised by a user via the selectable control 62 (which may engage the first elevator mechanism 100), the flange 142 preferably enters the channel 138 to not only lock the leg support device 10 vertically between the seat 20 and the supporting surface 12, but lock the leg support device 10 horizontally by restricting the movement of the flange within the channel 138.

Figure 22:
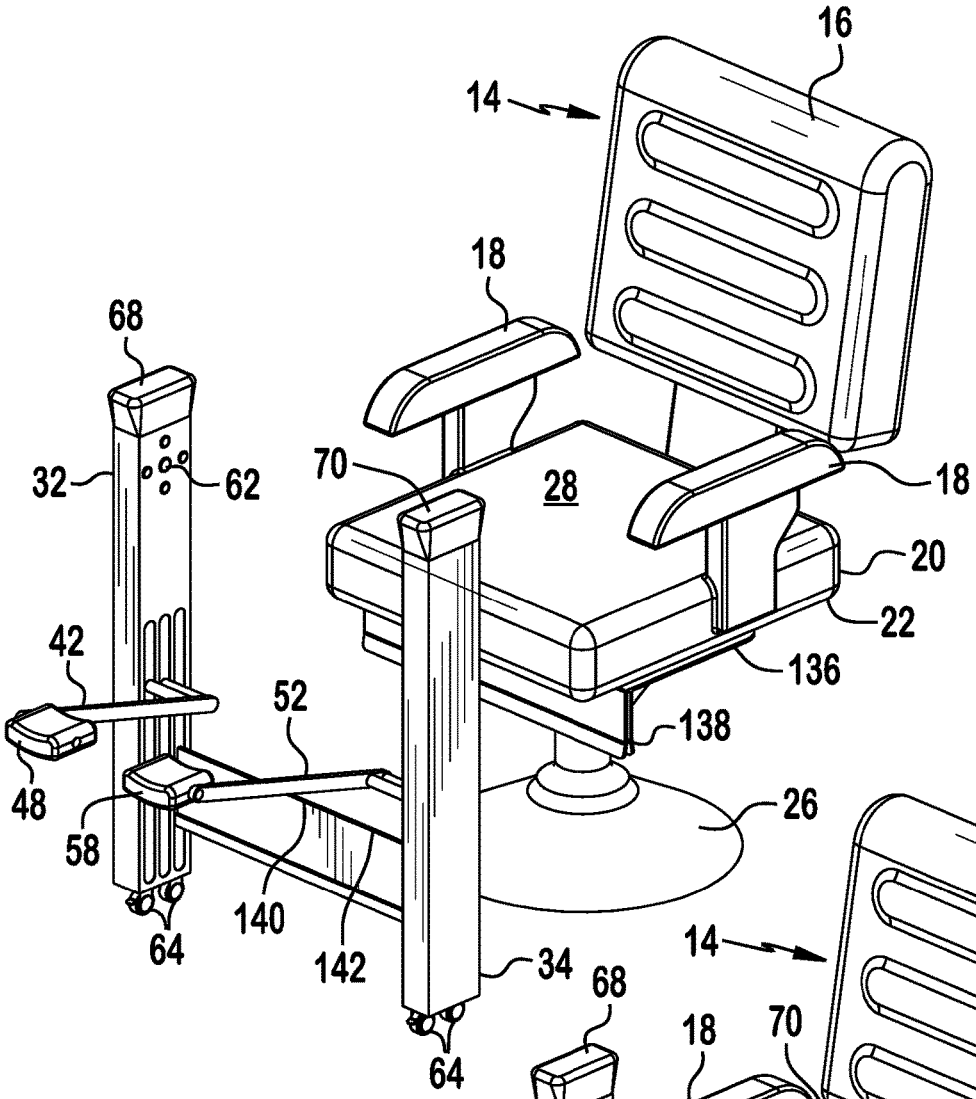
FIG. 22 is a front perspective view of a leg support system 10 according to an alternative preferred embodiment of the present invention. Here, the leg support system 10 can be seen positioned away from a chair 14. The tower connector 36 comprises an upper portion 140 which forms a flange 142. Connected to the underside 22 of the chair 14 is a bracket 136 defining a channel 138 therein.
Figure 23:
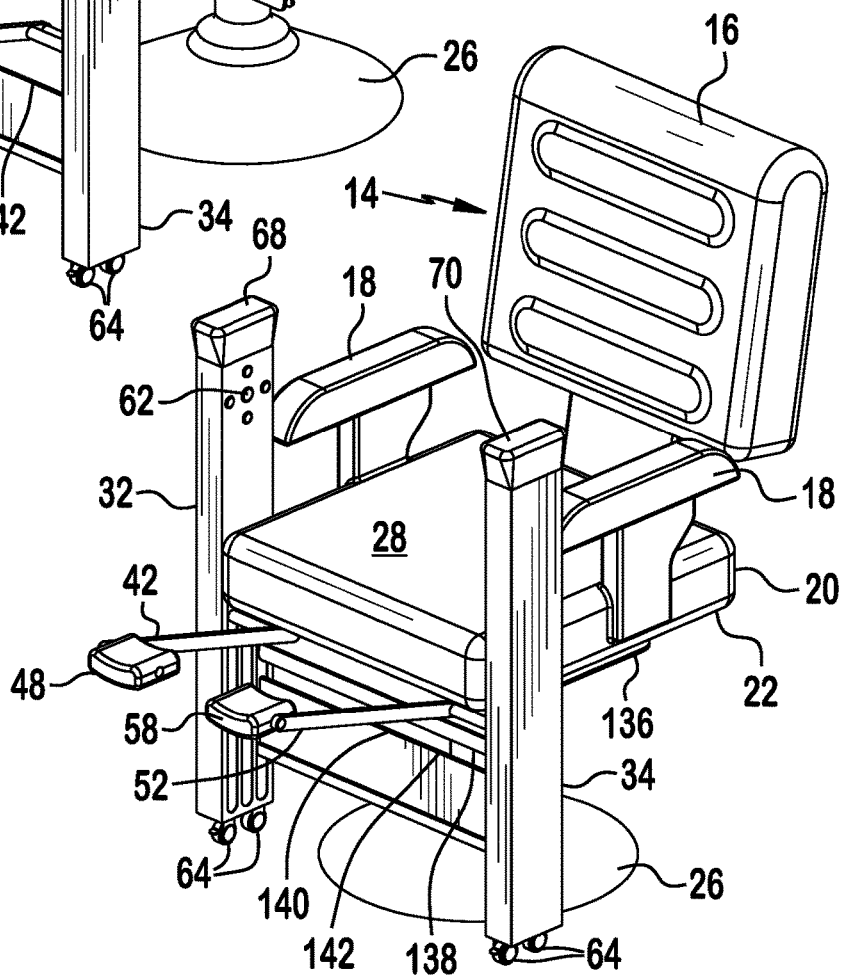
FIG. 23 is a front perspective view of the leg support system 10 of FIG. 22. Here, the tower connector 36 can be seen positioned underneath a chair 14 prior to being locked into position with the chair 14. The tower connector 36 comprises an upper portion 140 which forms a flange 142. Connected to the underside 22 of the chair 14 is a bracket 136 defining a channel 138 therein. In this configuration, the flange 142 is aligned to be engaged with the channel 138.

Referring specifically to FIG. 22, the leg support device 10 may be seen separated from and not in position under the chair 14. Referring specifically to FIG. 23, the leg support device may be seen separated from, but in position under, the chair 14. In both FIGS. 22 and 23, the tower connector 36 has not yet been raised.

Figure 24:
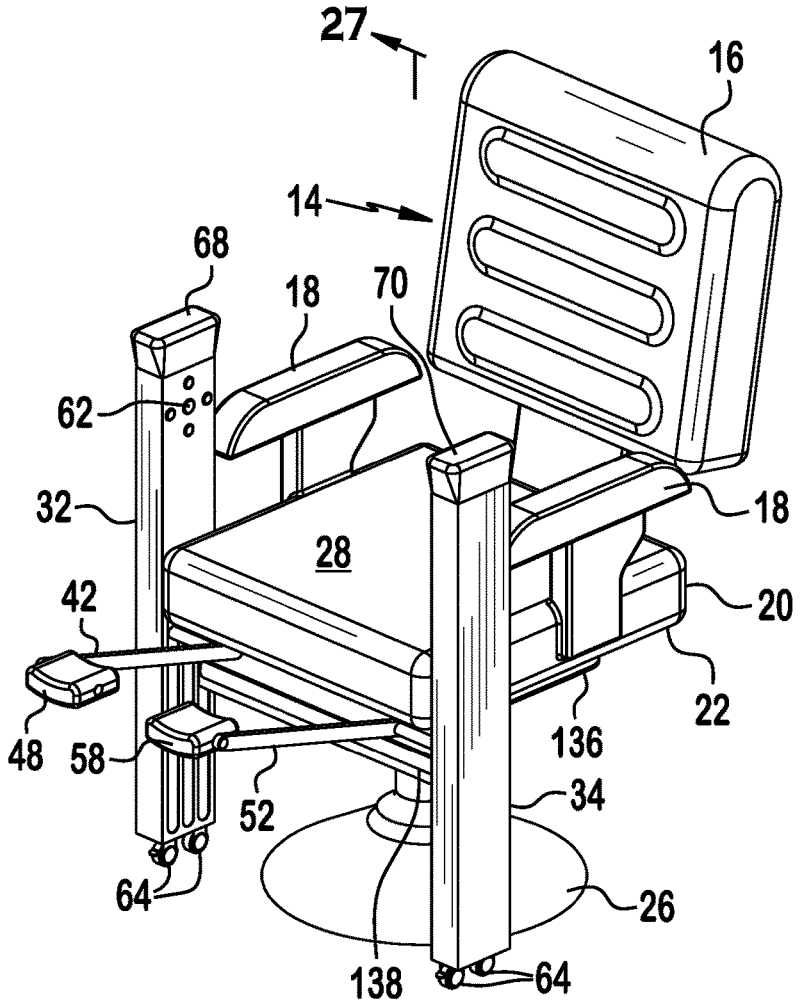
FIG. 24 is a front perspective view of a leg support system 10 according to an alternative preferred embodiment of the present invention. Here, the tower connector 36 can be seen positioned underneath a chair 14 after being locked into position with the chair 14. The tower connector 36 comprises an upper portion 140 which forms a flange 142. Connected to the underside 22 of the chair 14 is a bracket 136 defining a channel 138 therein. In this configuration, the flange 142 is aligned with the channel 138, and a flange 142 has entered the channel 138 thereby preventing movement of the leg support system 10 relative to the chair 14.
Figure 27:
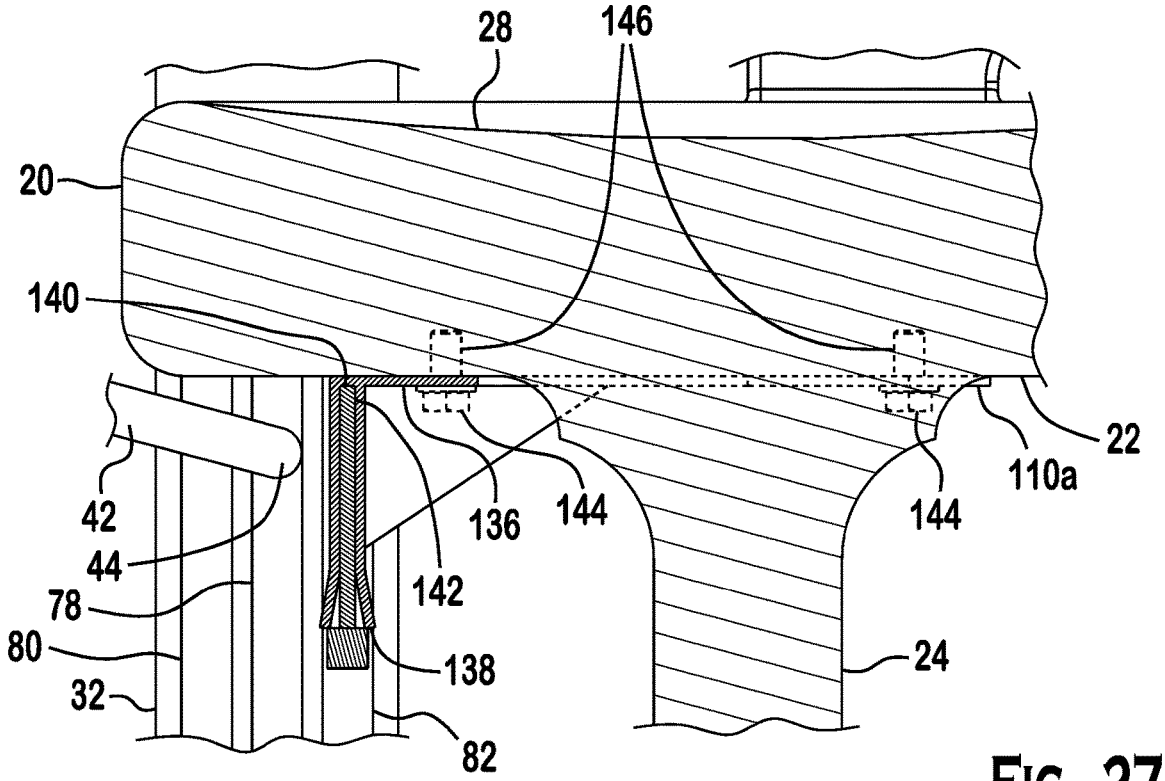
FIG. 27 is a side, cross-sectional view of a seat 20 is a view similar to FIG. 25 showing an alternative embodiment of the present invention. The seat 20 comprises an underside 22. The underside 22 defines a plurality of screw holes 146 therein. A plurality of screws 144 correspond to a plurality of screw holes 146 and are used to secure the bracket 136 to the seat 20.

Referring specifically two FIGS. 24 and 27, the tower connector 36 has now been raised into a locked position contacting the underside 22 of the seat 20. The flange 142 of the upper portion 140 of the tower connector 36 may be locked into the channel 138 of the bracket 136.

Figure 25:
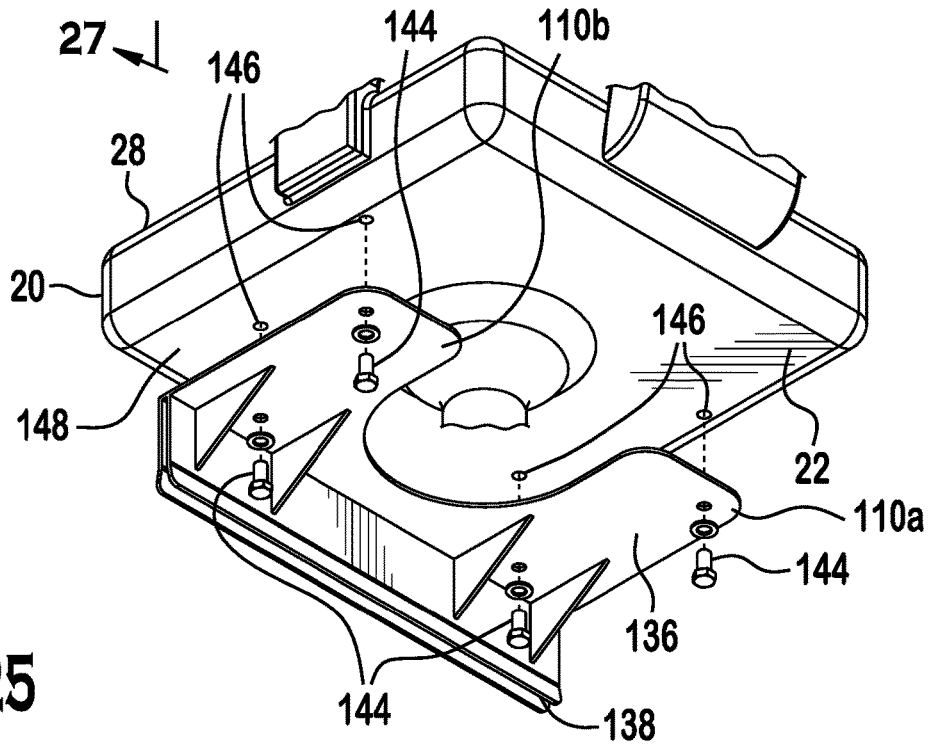
FIG. 25 is a partial exploded, bottom perspective view of a seat 20 of the leg support system 10 of FIG. 24. The seat 20 comprises an underside 22. The underside 22 defines a plurality of screw holes 146 therein. A plurality of screws 144 correspond to a plurality of screw holes 146 and are used to secure the bracket 136 to the seat 20.

Referring specifically to FIG. 25, the underside 22 of the seat 20 may comprise a plurality of fastener holes 146. The bracket 136 may be attached to the underside 22 via a plurality of fasteners 144 entering the plurality of fastener holes 146.

Figure 26:
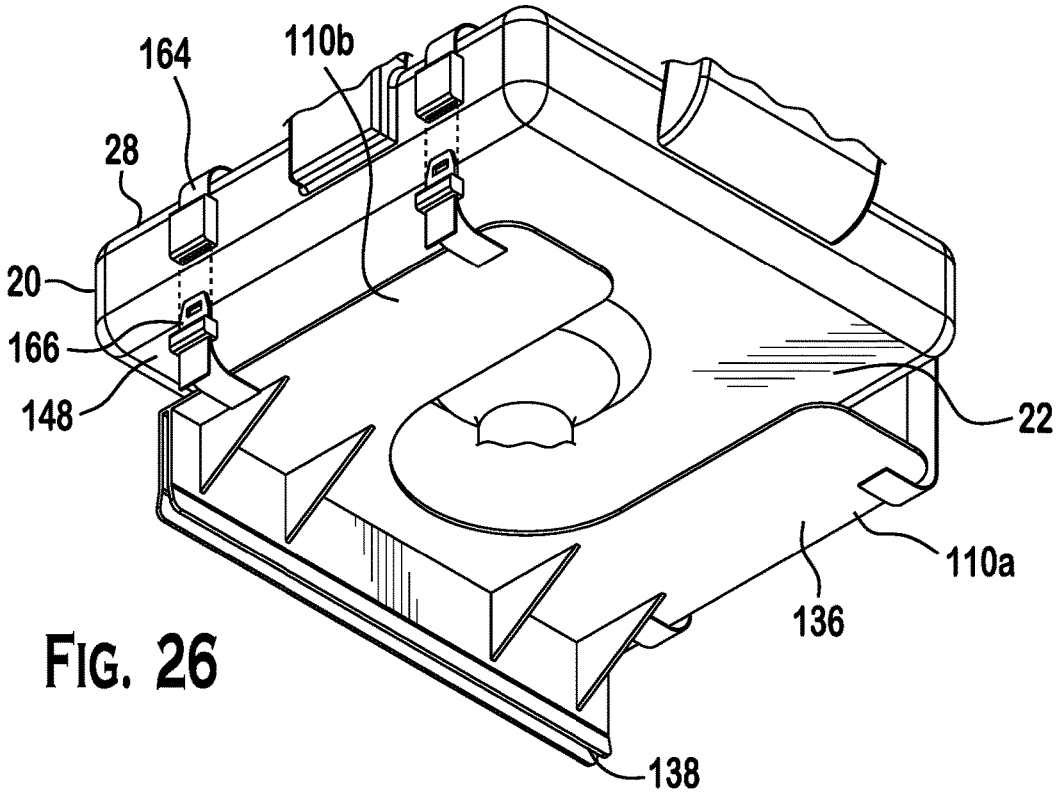
FIG. 26 is a view similar to FIG. 25 showing an alternative embodiment of the present invention. The seat 20 comprises an underside 22 configured to contact a bracket 136 mounted thereon. The bracket 136 is detachably affixed to the seat 20 via mounting straps 164 that surround the seat 20 and are connected via mounting buckles 166.

Referring specifically to FIG. 26, the bracket 136 may be attached to the underside 22 via mounting straps 164 which may wrap around the seat 20 and may be fastened via mounting buckles 166. The use of mounting straps 164 may be desirable over the plurality of fasteners 144 when the user does not wish to leave the bracket 136 connected to the seat 24 for a long period of time.

Figure 28:
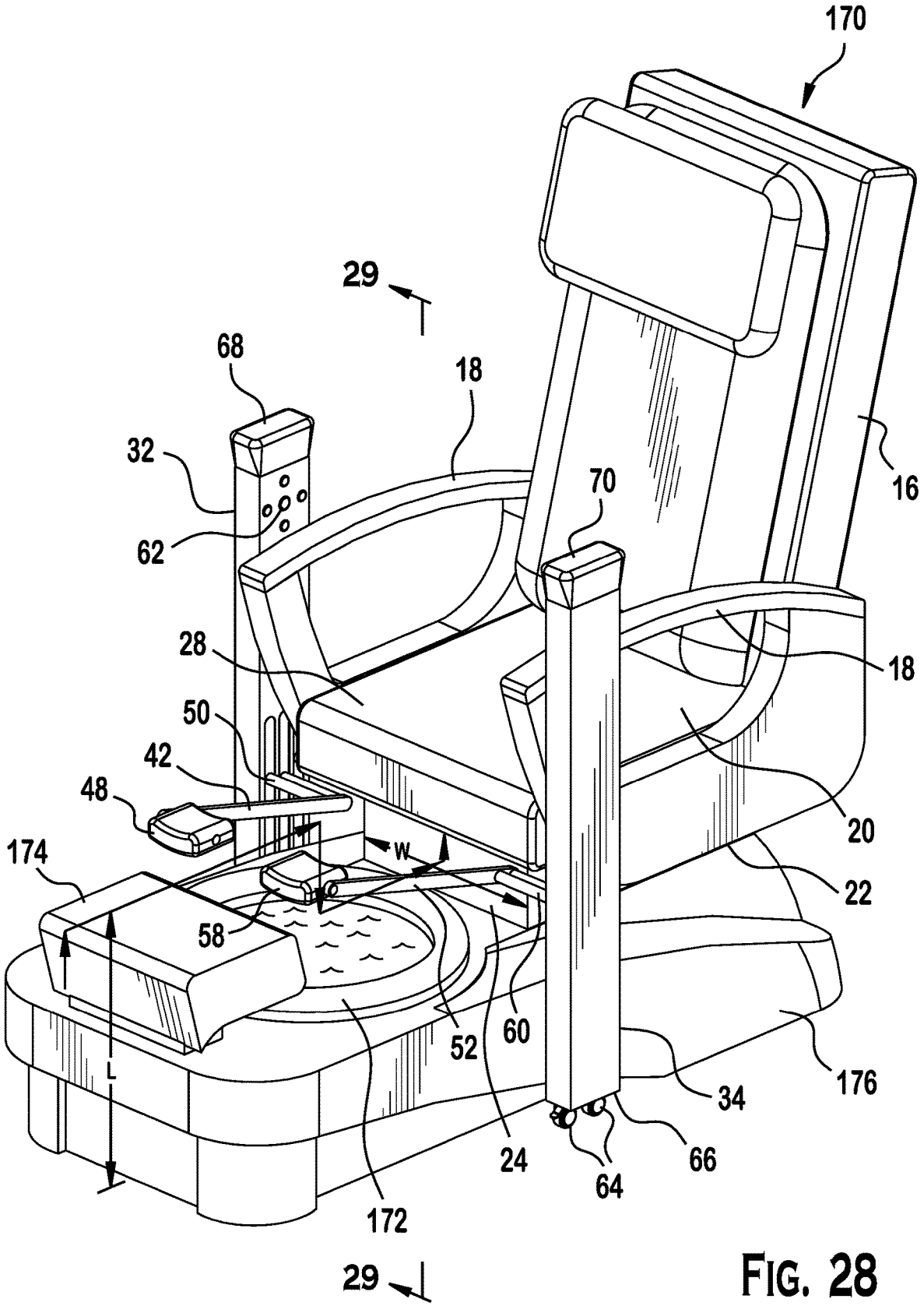
FIG. 28 is a front perspective view of a leg support system 10 according to an alternative preferred embodiment of the present invention. Here, the leg support system 10 is shown in use with a spa chair 170. The spa chair 170 may comprise a seatback 16, armrests 18, and a seat 20. The seat 20 may comprise an underside 22. The underside 22 may connect to a chair support post 24. The spa chair 170 may comprise a spa chair base 176 positioned on the supporting surface 12 and connected to the underside 22 by the chair support post 24. The spa chair base 176 may further comprise a foot bath 172 and a leg rest 174. The leg rest 174 may be at a leg rest height L above the supporting surface 12. The chair support 24 may have a chair support width W.
Figure 29:
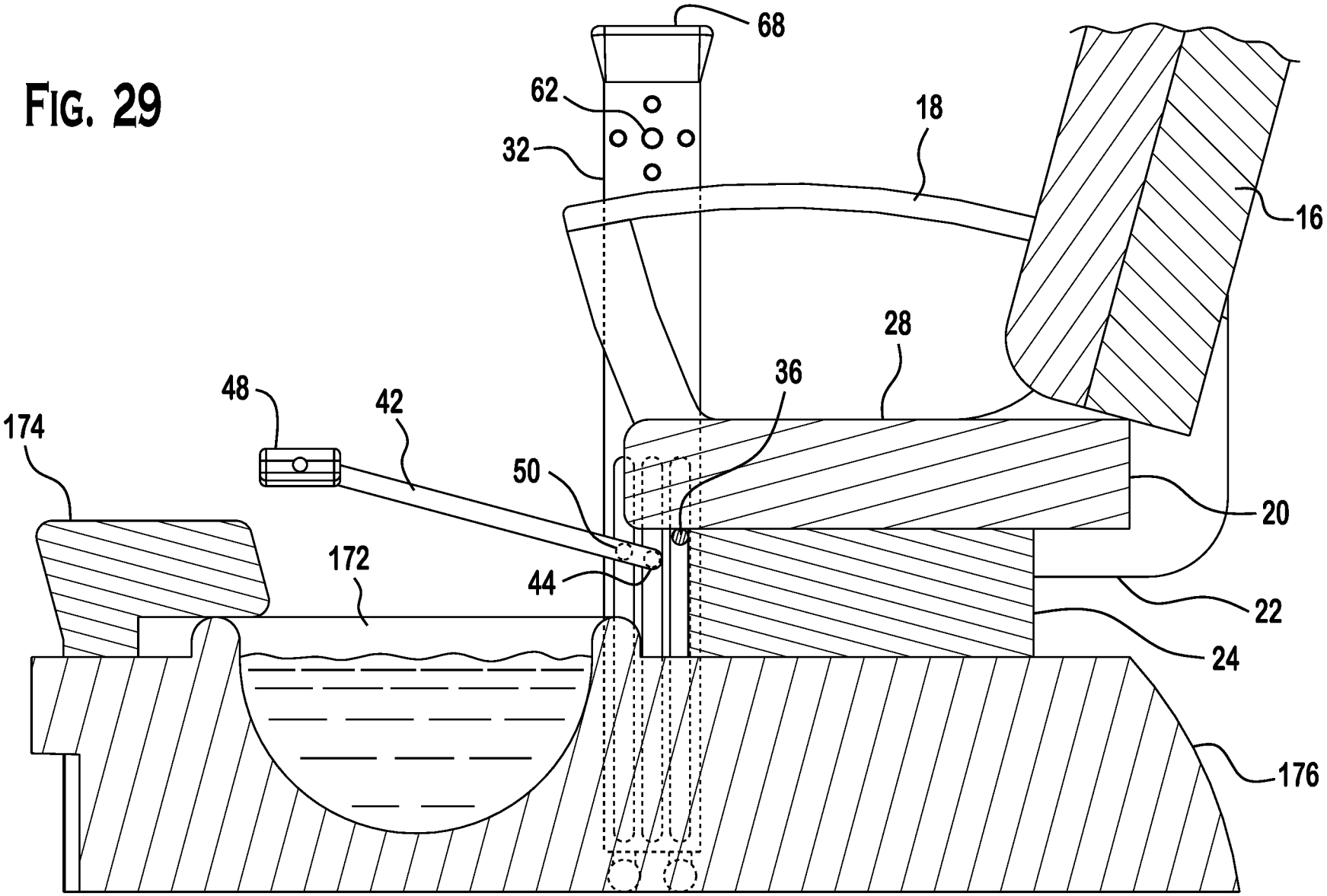
FIG. 29 is a cross-sectional view of a leg support system 10 of FIG. 28 as taken along the lines 29-29 in FIG. 28. This figure illustrates the leg support system 10 in place underneath the spa chair 170. Here, the tower connector 36 is positioned underneath the underside 22 and adjacent to the chair support post 24. The first leg support 42 extends over the foot bath 172. It can be seen that the length of the at least one drive component slot 76 and the at least one tower connector slot 82 is greater than the leg rest height L.

Referring now to FIGS. 28 and 29 of the preferred embodiment of the present invention, the leg support system 10 is shown in use with a spa chair 170. The spa chair 170 may comprise a foot bath 172 located in front of a seat 20 and under the first and second leg supports 42, 62. The spa chair 170 may further comprise a leg rest 174. The leg rest 174 may have a top surface located at a leg rest height L above the supporting surface 12. In order to position the leg support system 10 where the tower connector 36 is located under the underside 22, the tower connector 36 is preferably, but not necessarily, raised by the first elevator mechanism 100 to a height greater than the leg rest height L so that the tower connector 36 may pass over the leg rest 174.

Referring still to FIGS. 28 and 29 of the preferred embodiment of the present invention, the leg support system 10 is shown in use with a spa chair 170. The spa chair 170 may further comprise a spa chair base 176 positioned on the supporting surface 12. The spa chair base 176 may connect to the underside 22 of the seat 20 via a chair support post 24. The chair support post 24 may have a chair support width W. The spacing between the first support tower 32 and the second support tower 34 by the tower connector 36 must be at least as great as the chair support width W.

Figure 31:
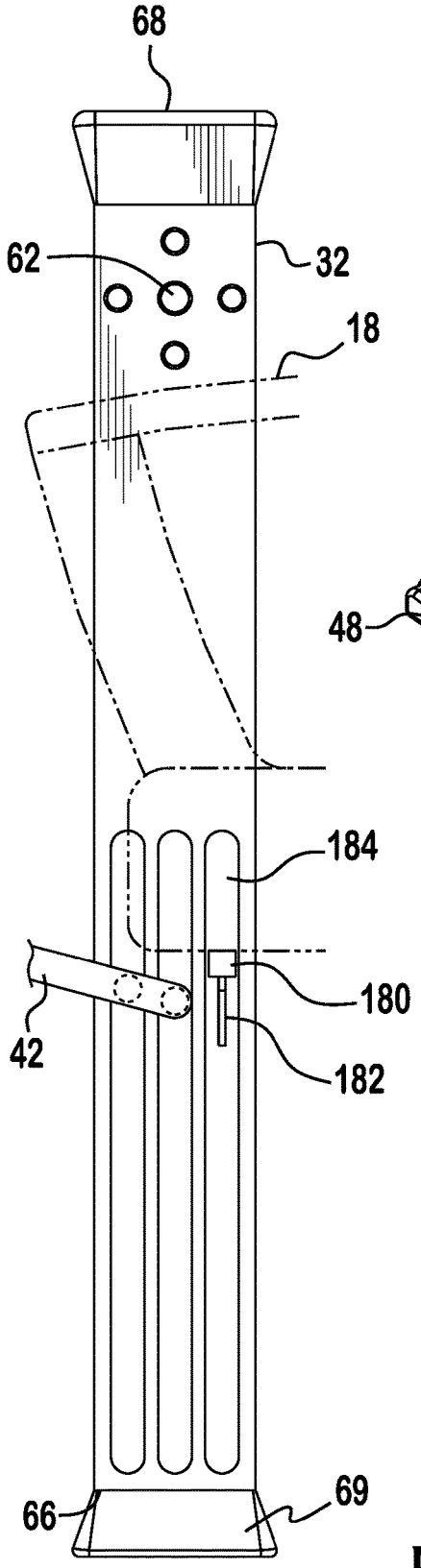
FIG. 31 is a side, cross-sectional view of a leg support system 10 of FIG. 30 as taken along the lines 31-31 in FIG. 30. This figure illustrates how a first support tower 32 may lock into place with the spa chair 170. The tower brace 180 is locked into place with the underside 22 exerting a force opposite to the supporting surface 12. The first support tower foot 69 contacts the supporting surface 12 two hold the first support tower 32 in place.
Figure 30:
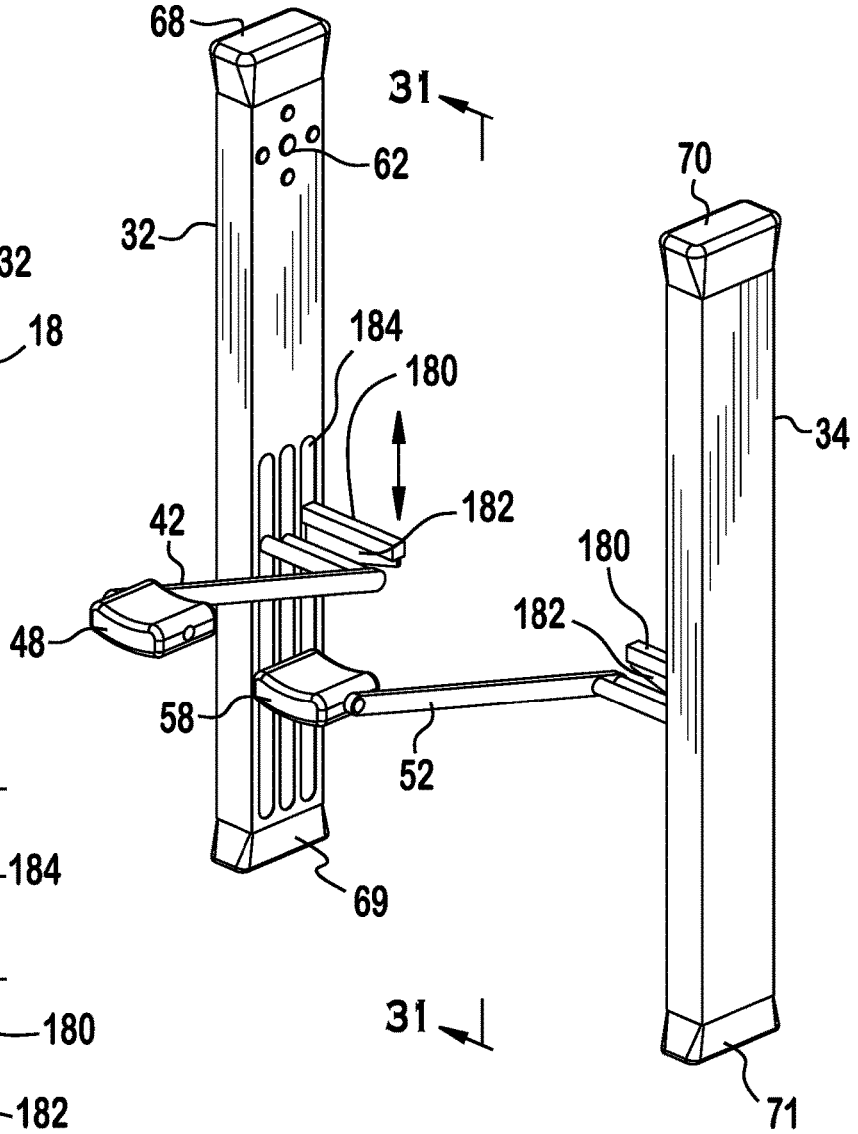
FIG. 30 is a front perspective view of a leg support system 10 according to an alternative preferred embodiment of the present invention for use with the spa chair 170. Here, the tower connector 36 of the preferred embodiment has been replaced with a tower brace 180. The tower brace 180 may comprise a brace flange 182. The tower brace 180 and the brace flange 182 extend outwardly from an at least one tower brace slot 184. The at least one tower brace slot 184 may replace the at least one tower connector slot 82 of the preferred embodiment. The first support tower 32 and the second support tower 34 are not connected in this alternative preferred embodiment of the present invention. The first support tower 32 comprises a first support tower foot 69 and the second support tower 34 comprises a second support tower foot 71.

Referring now to FIGS. 30 and 31 of the alternative preferred embodiment of the present invention, the first support tower 32 and the second support tower 34 may be unconnected. The tower connector 36 of the preferred embodiment may be substituted for tower braces 180. The first support tower 32 and the second support tower 34 may comprise at least one tower brace slot 184. The tower braces 180 may further comprise a tower brace flange 182. The tower brace flange 182 may provide for the rigidity and support to the tower brace 180. The first support tower 32 and the second support tower 34 may further comprise a first tower foot 69 and a second tower foot 71, respectively, located at their distal ends 66. One of ordinary skill in the art will appreciate from this disclosure that the first and second tower feet 69, 71 may be made of any substance suitable to prevent slipping and increase friction of grip strength such as rubber or the like without departing from the scope of the present invention.

Referring specifically to FIG. 31 of the alternative preferred embodiment of the present invention, the tower brace 180 may be seen positioned on the underside 22 of the seat 20. The tower brace 180 may be raised by the first elevator mechanism 100 so that it firmly presses into place on the underside 22. The opposite forces exerted by the tower brace 180 on the underside 22 and the first tower foot 69 on the supporting surface 12 may lock the first support tower 32 into position with the spa chair 170. The first support tower 32 being disconnected from the second support tower 34 may be advantageous to allow a user to position the first support tower 32 and the second support tower 34 without having to avoid any obstacles that may be in the way of the tower connector 36 when positioning the leg support system 10.

Figure 33:
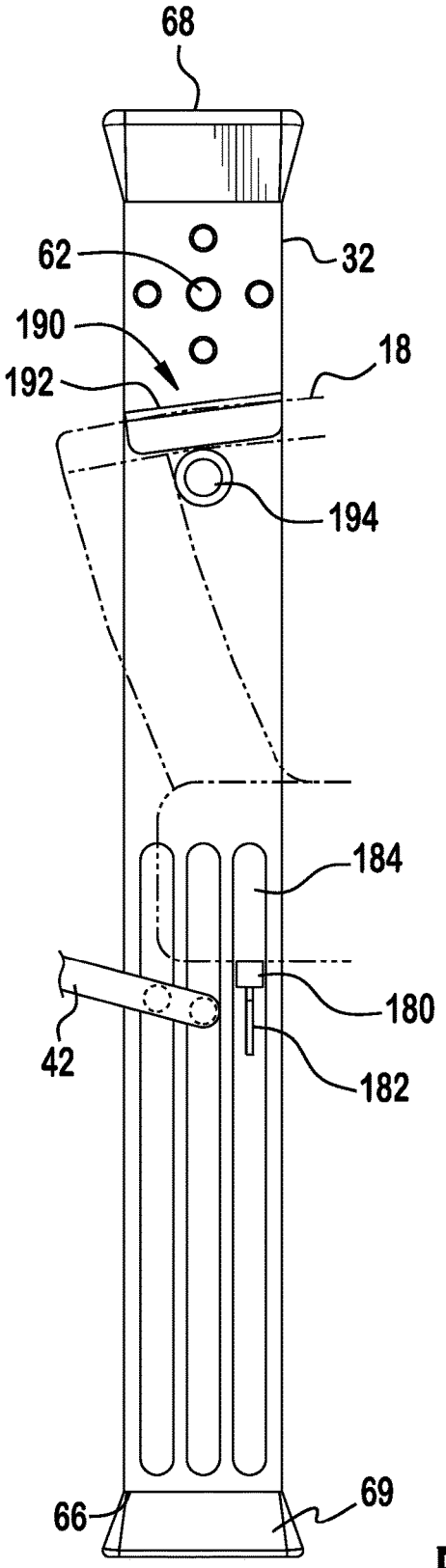
FIG. 33 is a side, cross-sectional view of a leg support system 10 of FIG. 32 as taken along the lines 33-33 in FIG. 32. This figure illustrates how a first support tower 32 including the arm rest guide 190 may lock into place with the spa chair 170. The arm rest 18 fits into the space between the sleeve 192 and the roller 194. The arm rest guide 190 allows the first support tower 32 to properly align with the spa chair 170 locking into place.
Figure 32:
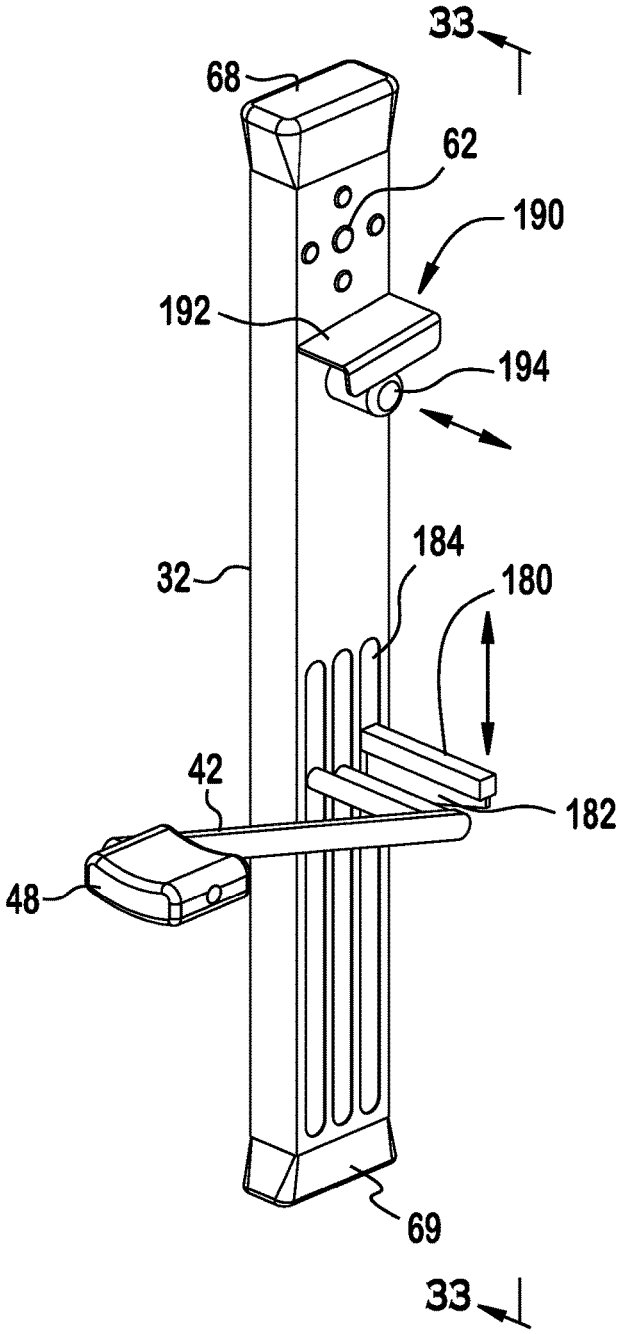
FIG. 32 is a front perspective view of a leg support system 10 according to an alternative preferred embodiment of the present invention for use with the spa chair 170. Here, the first support tower 32 comprises an arm rest guide 190. The arm rest guide 190 may comprise a sleeve 192 and a roller 194. The arm rest guide 190 may accommodate the arm rest 18. In one embodiment, the roller 194 may be depressible to allow a portion of the armrest to pass through prior to sandwiching a portion of the armrest between the roller 194 and the sleeve 192. Those of ordinary skill in the art will appreciate from this disclosure that the roller 194 could just be a smooth abutment with no rolling capability without departing from the scope of the present invention.

Referring now to FIGS. 32 and 33 of the alternative preferred embodiment of the present invention, the first tower support 32 can be seen comprising an arm rest guide 190. The arm rest guide 190 may be positioned on an outer surface of the first support tower 32. The arm rest guide 190 may comprise a sleeve 192 and a roller 194. The sleeve 192 may contact a top surface of an arm rest 18 of the spa chair 170. The roller 194 may contact a bottom surface of the arm rest 18 of the spa chair 170. The purpose of the arm rest guide 190 may be to allow movement of the arm rest 18 when placing the first support tower 32 into position with the spa chair 170. The arm rest guide 190 may provide for the stability and support to the leg support system 10 when in use with a spa chair 170. In one embodiment, the roller 194 may be depressible to allow a portion of the armrest to pass through prior to sandwiching a portion of the armrest between the roller 194 and the sleeve 192. Those of ordinary skill in the art will appreciate from this disclosure that the roller 194 could just be a smooth abutment with no rolling capability without departing from the scope of the present invention.

Figure 35:
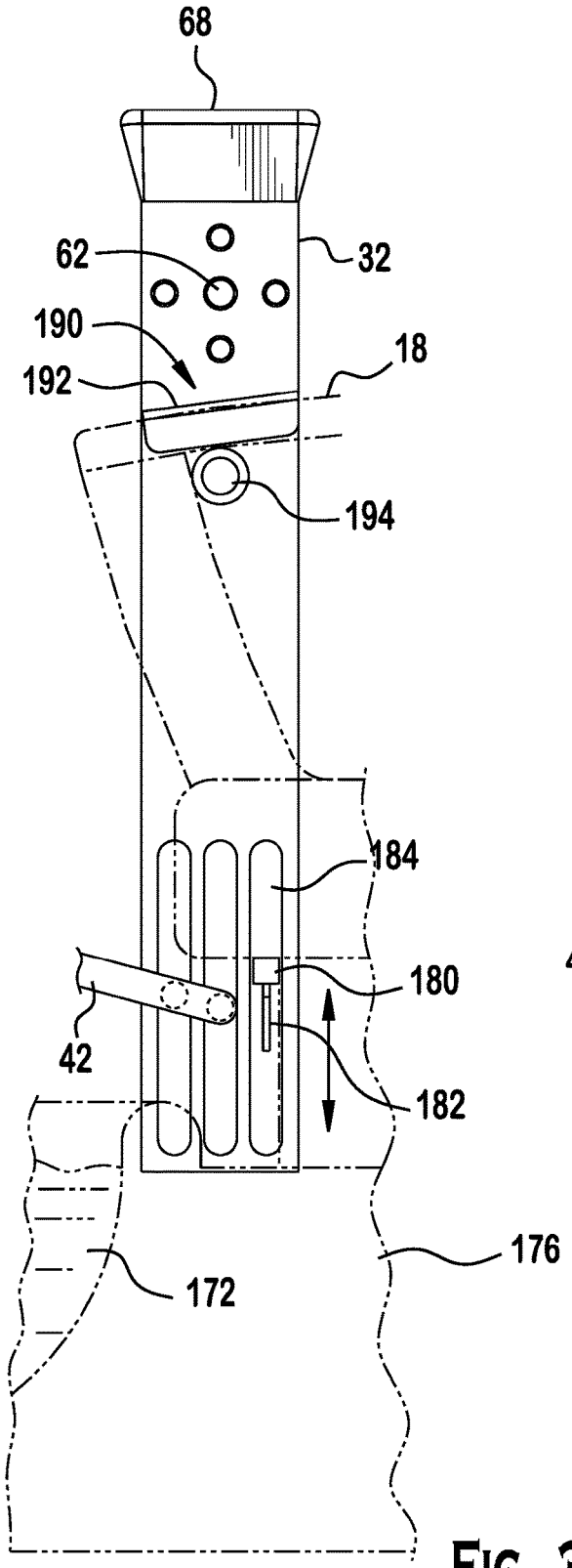
FIG. 35 is a side, cross-sectional view of a leg support system 10 of FIG. 34 as taken along the lines 35-35 in FIG. 34. This figure illustrates how the first support tower 32 that has been shortened can be positioned on the spa chair base 176 of the spa chair 170. The distal ends 66 now rests on the spa chair base 176. Here, the arm rest 18 is also locked into the arm rest guide 190.
Figure 34:
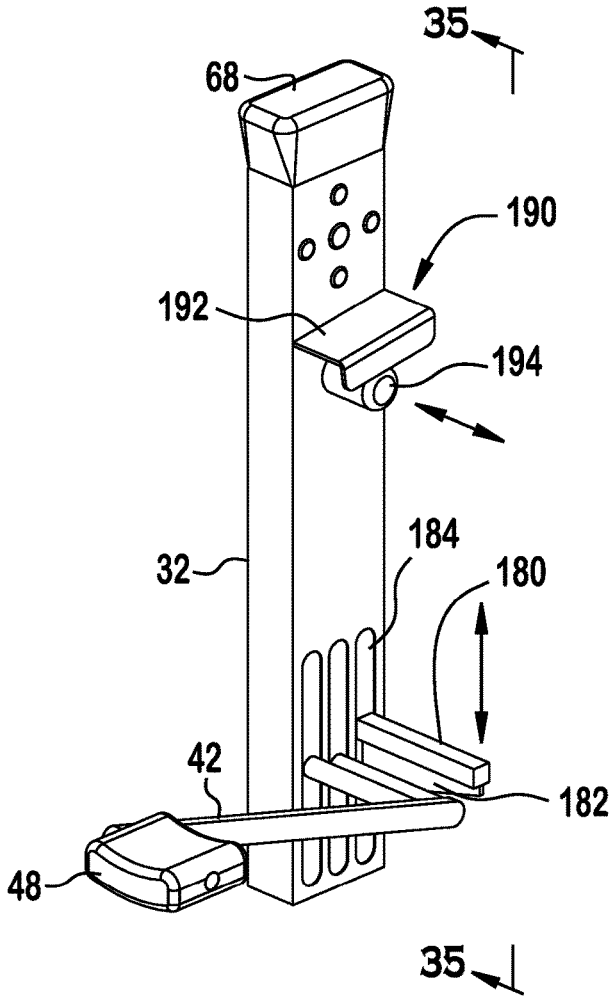
FIG. 34 is a front perspective view of a leg support system 10 according to an alternative preferred embodiment of the present invention for use with the spa chair 170. Here, the first support tower 32 has been shortened. The distal end 66 is no longer positioned on the supporting surface 12. The two primary points of contact to lock the leg support system 10 into place with the spa chair 170 are now the tower brace 180 and the arm rest guide 190.

Referring now to FIGS. 34 and 35 of the alternative preferred embodiment of the present invention, the first support tower 32 may be shortened such that the distal ends 66 is located closer to the first tower cap 68. The first support tower 32 may now be positioned on the spa chair base 176 of the spa chair 170 instead of on the supporting surface 12. However, this alternative preferred embodiment featuring the shortened first support tower 32 operates similarly to the embodiment illustrated by FIGS. 32 and 33. The only difference between these alternative preferred embodiments is that in FIGS. 34 and 35 the first support tower 32 rests on the spa chair base 176 and not the supporting surface 12. The advantage of this alternative preferred embodiment is that there may be a lower material cost due to the shorter first support tower 32 as well as a lighter weight of the leg support system 10.

One of ordinary skill in the art will appreciate from this disclosure that the various components and elements of the present invention may be constructed of any suitably strong, wear-resistant, flexible (where desired), and inexpensive metals, polymers, alloys, plastics, and other materials without departing from the scope of the present invention.

One of ordinary skill in the art will appreciate from this disclosure that device elements, as well as materials, shapes and dimensions of device elements, as well as methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed, described in the specification, and/or shown in the drawings. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention.

What is claimed is:

1. A leg support system which is positionable on a supporting surface and is configured to support a first leg of a user, the leg support system comprising:

a first leg support having a first leg support axial end;

a housing, comprising:

a first support tower;

a second support tower, the first support tower and the second support tower being positioned on the supporting surface, and a tower connector having first and second support tower connector axial ends each located on a separate one of the first and second support towers;

connecting the first support tower to the second support tower;

a first elevator mechanism located in the first support tower, the first elevator mechanism being configured to raise and/or lower a first height of the tower connector, the first height being measured from the supporting surface;

a first drive component linking the first leg support to the first elevator mechanism such that first elevator mechanism is configured to raise and/or lower a second height of the first leg support, the second height being measured from the supporting surface;

a selectable control for operating the first elevator mechanism, the selectable control being in communication with the first elevator mechanism and being configured to activate the first elevator mechanism;

wherein the leg support system is configured to allow the user to adjust the position of the first leg support.

2. The leg support system of claim 1, wherein the first leg support comprises:

a first leg support distal end opposite the first leg support axial end; and a first leg pad configured to contact and support the user's leg;

wherein the first leg support distal end attaches to the first leg pad.

3. The leg support system of claim 1, wherein the tower connector is configured to be telescopic such that a distance between the first support tower and the second support tower can be adjusted.

4. The leg support system of claim 1, wherein the first support tower and the second support tower each comprise a distal end configured for placement closest to the supporting surface and each having a plurality of wheels thereon which are configured to contact the supporting surface.

5. The leg support system of claim 1, wherein the first support tower defines at least one tower connector slot and at least one drive component slot, the at least one tower connector slot being configured to accommodate the tower connector, and the at least one drive component slot being configured to accommodate the first drive component.

6. The leg support system of claim 5, wherein the tower connector extends through the at least one tower connector slot to engage the first elevator mechanism which is configured to adjust the first height of the tower connector.

7. The leg support system of claim 6, wherein the at least one drive component slot comprises a first drive component slot and a second drive component slot; the first drive component comprising first and second rods; the first elevator mechanism being configured to adjust the position of the first and second rods in the first and second drive component slots such that the second height of the first leg support can be varied and such that an angle of the first leg support relative to the supporting surface can be adjusted.

8. The leg support system of claim 6, wherein the first drive component comprises a drive housing enclosing a motor, the drive housing being engaged with the elevator mechanism through the at least one drive component slot such that the first elevator mechanism can adjust the second height of the first leg support, the motor being configured to adjust an angle of the first leg support relative to the supporting surface.

9. The leg support system of claim 6, wherein the first elevator mechanism further comprises:

at least one elevator motor;

a plurality of threaded rods positioned generally perpendicular to the supporting surface and configured to be rotated by the at least one elevator motor; and a plurality of riding elements each having one of the plurality of threaded rods extending therethrough such that rotation of the one of the plurality of rods adjusts a vertical position of the riding element;

an edge of the at least one tower connector slot and/or the at least one drive component slot being configured to prevent rotation of the plurality of riding elements such that rotation of the plurality of rods is translated into vertical motion of the plurality of riding elements.

10. The leg support system of claim 6, wherein the first elevator mechanism further comprises:

at least one elevator motor;

a plurality of threaded rods positioned generally perpendicular to the supporting surface and configured to be rotated by the at least one elevator motor; and a plurality of riding elements each having one of the plurality of threaded rods extending therethrough such that rotation of the one of the plurality of rods adjusts a vertical position of the riding element;

each of the plurality of riding elements being prevented rotation by one of the tower connector and the first drive component such that rotation of the plurality of rods is translated into vertical motion of the plurality of riding elements.

11. The leg support system of claim 6, wherein the first elevator mechanism further comprises:

at least one elevator motor;

a plurality of threaded rods positioned generally perpendicular to the supporting surface and configured to be rotated by the at least one elevator motor; and wherein each of the tower connector and the first drive component are engaged with at least one of the plurality of threaded rods such that rotation of the at least one of the plurality of rods adjusts a vertical position thereof.

12. The leg support system of claim 1, the housing being configured such that the tower connector is adapted to be positioned underneath an underside of a chair and then raised by the first elevator mechanism to contact the underside so that the housing can be braced between the chair and the supporting surface.

13. The leg support system of claim 12, further comprising the chair.

14. The leg support system of claim 13, further comprising a bracket positioned on the underside of the chair, the bracket defining a channel therein, the tower connector having an upper portion defined by a flange such that when the tower connector is raised to brace against the chair the flange is inserted into the channel of the bracket.

15. The leg support system of claim 13, further comprising a wing plate located on the tower connector which is moveable between a first, folded, position in which the wing plate is generally parallel to the tower connector and a second, extended position in which the wing plate extends outwardly away from the tower connector to contact a portion of the underside of the chair.

16. The leg support system of claim 13, wherein the tower connector comprises two crossbars with a plate therebetween.

17. The leg support system of claim 1, further comprising a first strut positioned on the first support tower and extending away from the first support tower, the first strut being configured to contact the supporting surface so that the housing has extra resistance to pivoting about a bottom of the first and second support towers.

18. A leg support system which is positionable on a supporting surface and is configured to support a first leg of a user, the leg support system comprising:

a first leg support having a first leg support axial end;

a housing, comprising:

a first support tower;

a second support tower, the first support tower and the second support tower being positioned on the supporting surface, and a tower connector having first and second support tower connector axial ends each located on a separate one of the first and second support towers; connecting the first support tower to the second support tower;

a first elevator mechanism located in the first support tower, the first elevator mechanism being configured to raise and/or lower a first height of the tower connector, the first height being measured from the supporting surface;

a first drive component linking the first leg support to the first elevator mechanism such that first elevator mechanism is configured to raise and/or lower a second height of the first leg support, the second height being measured from the supporting surface;

a selectable control for operating the first elevator mechanism, the selectable control being in communication with the first elevator mechanism and being configured to activate the first elevator mechanism;

wherein the leg support system is configured to allow the user to adjust the position of the first leg support;

wherein the first support tower defines at least one tower connector slot and at least one drive component slot, the at least one tower connector slot being configured to accommodate the tower connector, and the at least one drive component slot being configured to accommodate the first drive component;

wherein the tower connector extends through the at least one tower connector slot to engage the first elevator mechanism which is configured to adjust the first height of the tower connector; and wherein the at least one drive component slot comprises a first drive component slot and a second drive component slot, the first drive component comprising first and second rods, the first elevator mechanism being configured to adjust the position of the first and second rods in the first and second drive component slots such that the second height of the first leg support can be varied and such that an angle of the first leg support relative to the supporting surface can be adjusted.

19. A combination chair and leg support system which is positionable on a supporting surface and is configured to support a first leg of a user, the combination chair and leg support system comprising:

a chair, comprising:

a seatback; and a seat having an underside; and a leg support system, comprising:

a first leg support having a first leg support axial end;

a housing, comprising:

a first support tower;

a second support tower, the first support tower and the second support tower being positioned on the supporting surface, and a tower connector having first and second support tower connector axial ends each located on a separate one of the first and second support towers;

connecting the first support tower to the second support tower;

a first elevator mechanism located in the first support tower, the first elevator mechanism being configured to raise and/or lower a first height of the tower connector, the first height being measured from the supporting surface;

a first drive component linking the first leg support to the first elevator mechanism such that first elevator mechanism is configured to raise and/or lower a second height of the first leg support, the second height being measured from the supporting surface;

a selectable control for operating the first elevator mechanism, the selectable control being in communication with the first elevator mechanism and being configured to activate the first elevator mechanism;

wherein the leg support system is configured to allow the user to adjust the position of the first leg support.

20. The combination chair and leg support system of claim 19, the housing being configured such that the tower connector is adapted to be positioned underneath the underside of the chair and then raised by the first elevator mechanism to contact the underside so that the housing can be braced between the chair and the supporting surface.

* * * * *